US007346307B2

(12) United States Patent
Honda et al.

(10) Patent No.: US 7,346,307 B2
(45) Date of Patent: Mar. 18, 2008

(54) AMORPHOUS AND SPHERICAL TONER CLEANING UNIT AND IMAGE FORMING APPARATUS LOADING THE SAME

(75) Inventors: Mitsunobu Honda, Osaka (JP); Minoru Wada, Osaka (JP); Eiji Gyoutoku, Osaka (JP); Hisashi Mukataka, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 9 days.

(21) Appl. No.: 11/295,541

(22) Filed: Dec. 7, 2005

(65) Prior Publication Data

US 2006/0127145 A1 Jun. 15, 2006

(30) Foreign Application Priority Data

Dec. 9, 2004 (JP) ..... 2004-356674
Dec. 9, 2004 (JP) ..... 2004-356701

(51) Int. Cl.
*G03G 21/00* (2006.01)

(52) U.S. Cl. ..... 399/349; 399/350

(58) Field of Classification Search ..... 399/98, 399/99, 343, 349, 350
See application file for complete search history.

(56) References Cited

U.S. PATENT DOCUMENTS 5,606,408 A * 2/1997 Yano et al. ..... 399/343
5,740,494 A * 4/1998 Shoji et al. ..... 399/71
6,125,257 A * 9/2000 Sekine et al. ..... 399/343

FOREIGN PATENT DOCUMENTS

JP 08-254873 10/1996

* cited by examiner

*Primary Examiner*—David M. Gray
*Assistant Examiner*—Ruth N LaBombard
(74) *Attorney, Agent, or Firm*—Smith, Gambrell & Russell, LLP

(57) ABSTRACT

In an image forming apparatus that uses toners of a plurality of different colors, amorphous toner is used during image forming with a first color. Then, a controller, by using a toner remaining-removing switching device, causes toner scraped off from an image carrier by a blade during cleaning to remain at a predetermined region near the blade. Spherical toner is used during image forming with a second color and thereafter. The controller switches the toner remaining-removing switching device during any one of processes starting from the process of the second color until the end of image formation to remove toner remaining at the predetermined region, and the toner subsequently scraped off, from the image carrier.

22 Claims, 17 Drawing Sheets

AMORPHOUS AND SPHERICAL TONER CLEANING UNIT AND IMAGE FORMING APPARATUS LOADING THE SAME

This application is based on Japanese Patent Application No. 2004-356674 and Japanese Patent Application No. 2004-356701 filed on Dec. 9, 2004, the contents of which are hereby incorporated by reference.

BACKGROUND OF THE INVENTION

1. Field of the Invention

The present relates to a cleaning unit that performs cleaning by removing a toner remaining on the surface of an image carrier after a toner image is transferred onto paper. The present invention also relates to an image forming apparatus including the cleaning unit.

2. Description of Related Art

In an electrophotographic image forming apparatus, transferring onto paper a toner image formed on the surface of an image carrier or a photosensitive drum is achieved by a method such as transferring a toner image by bringing the paper into direct contact with the photosensitive drum, or first performing primary transfer of the toner image onto an intermediate transfer body formed of another drum or belt and then performing secondary transfer of the toner image onto the paper. Of these methods, the latter transfer method employing the intermediate transfer body is widely used for color printing where a plurality of different colors are used. In this case, toners of the plurality of colors are primarily transferred in a sequential manner onto the intermediate transfer body to form a color toner image thereon, and then a final color toner image is secondarily transferred onto paper at the end.

With such a transfer method, a small amount of toner may remain on the surface of the photosensitive drum even after a toner image is transferred onto paper or the intermediate transfer body. This toner remaining on the surface of the photosensitive drum disturbs the following formation of a new image, thus requiring cleaning. Well-known cleaning methods employed for this purpose includes: transferring a remaining toner onto a rotary member, such as a roller or a rotary brush, for collection by pressing the rotary member against the surface of the photosensitive drum; scraping off a remaining toner with a blade being brought into contact with the surface of the photosensitive drum; and a combination of these methods.

As for an image forming apparatus employing a toner, downsizing of the toner diameter has been pursued in recent years with the objective of forming clear, high-quality images. As a conventional toner manufacturing method, a pulverizing method is used in which toner particles are produced by blowing off a heated plastic material with a strong air pressure and hitting the material against the wall to pulverize it. However, downsizing the toner diameter by use of the pulverizing method results in poor yield and thus an increase in toner manufacturing costs.

Thus, in place of the pulverizing method, a polymerization method has become increasingly widespread as an alternative toner manufacturing method. The polymerization method is a method of producing toner particles by binding substances, sources of a toner, through chemical reaction. In comparison to the conventional pulverizing method, the polymerization method consumes smaller energy, thus attracting attention as a toner manufacturing method that is environmentally friendly. This polymerization method is capable of producing toners of the same shape and size, thus achieving formation of even clearer, higher-quality images.

However, a toner manufactured by the polymerization method suffers from great difficulties in its cleaning, adversely affected by its small diameter and its shape closer to a spherical shape. That is, a toner manufactured by the polymerization method is formed into a shape such that its surface as a whole is hardly caught. This makes it difficult to remove the toner by catching it with the rotary member or the blade. Cleaning methods have been proposed which are capable of achieving a satisfactory cleaning performance by use of an amorphous toner in addition to a spherical toner manufactured by a polymerization method during cleaning of the spherical toner. Japanese Patent Application Laid-open No. H8-254873 discloses one example of such cleaning methods.

With the method of cleaning performed by an image forming apparatus as described in Japanese Patent Application Laid-open No. H8-254873, before development of an image portion with spherical toners of different colors, a development region is formed with an amorphous toner on the non-image area on the leading end side of a photosensitive drum in the surface movement direction thereof so that the amorphous toner is interposed between the blade and a spherical toner upon cleaning, thereby making it easier to clean the spherical toner. However, with this method, an amorphous toner is developed on the non-image area in each development process achieved with each of the spherical toners of different colors, thereby resulting in waste of an unnecessary toner that will never be transferred onto paper, which leads to higher running costs and a possibility of adverse effect from the viewpoint of natural resource saving.

SUMMARY OF THE INVENTION

In view of the problem described above, the present invention has been made, and it is an object of the invention to provide a cleaning unit that can maintain a satisfactory performance in cleaning a toner remaining on the surface of an image carrier without impairment to a clear, high-quality image obtained by using a spherical toner. It is another object of the invention to provide an image forming apparatus that is equipped with such a cleaning unit and that offers a high performance with low running costs and with consideration to resources and environment.

To achieve the object described above, one aspect of the present invention relates to a cleaning unit for, in order to achieve image formation by use of an amorphous and spherical toners of a plurality of different colors, sequentially cleaning a toner remaining on the surface of an image carrier, which repeats a process comprising development, transfer, and cleaning for each of the colors, by a blade making contact with the image carrier and then scraping off the toner adhering to the surface thereof for each process. The cleaning unit includes: toner remaining-removing switching means that is provided upstream of the blade in the rotation direction of the image carrier and that permits switching such that the toner scraped off remains at a region where the blade and the image carrier make contact with each other or the toner is removed from the region; and a controller for controlling switching made by the toner remaining-removing switching means. The process by use of the amorphous toner is first performed in the image formation. The controller switches the toner remaining-removing switching means to make the toner scraped off remain at the region during the cleaning in the first process and maintains the toner remaining on the region, and thereafter switches the toner remaining-removing switching means to make the toner scraped off removed from the region during the cleaning starting from any of the subsequent processes until the end of the image formation.

According to the configuration described above, although an amorphous toner is used for one color, spherical toners, which can be produced at low cost and which provide high quality, are used for other colors, thus achieving a high-quality image while easily overcoming cleaning failures involved with the use of spherical toners.

The toner remaining-removing switching means is formed of a rotary member which makes contact with the image carrier and whose rotation direction is controlled by the controller such that, in order to make a toner remain on the region, a surface of the rotary member at an area in contact with the image carrier rotates in the direction opposite to the moving direction of the surface of the image carrier, and such that, in order to make a toner removed from the region, the surface of the rotary member at the area in contact with the image carrier rotates in the same direction as the moving direction of the surface of the image carrier.

The toner remaining-removing switching means includes: a rotary member which makes contact with the image carrier and whose surface at an area in contact with the image carrier rotates in the same direction as the moving direction of the surface of the image carrier, and a power supply portion which is controlled by the controller to apply to the rotary member a bias voltage with a polarity opposite to the charge polarity of a toner in order to make the toner remain on the region and to apply to the rotary member a bias voltage with a polarity equal to the charge polarity of a toner in order to make the toner removed from the region.

The toner remaining-removing switching means includes: a rotary member which makes contact with the image carrier and whose surface at an area in contact with the image carrier rotates in the same direction as the moving direction of the surface of the image carrier, and a scraper which is controlled by the controller to be at a position separated from the surface of the rotary member in order to make a toner remain on the region and which is controlled by the controller to be at a position in contact with the surface of the rotary member in order to make a toner removed from the region.

In any of the cases described above, since already available components and structures which are usually provided to a cleaning unit are used, no additional devices and no additional space for their attachment are required, thus achieving cost reduction and space saving of the cleaning unit.

DETAILED DESCRIPTION OF PREFERRED EMBODIMENTS

The embodiment of the present invention will be described with reference to FIGS. 1 to 24.

Figure 1:
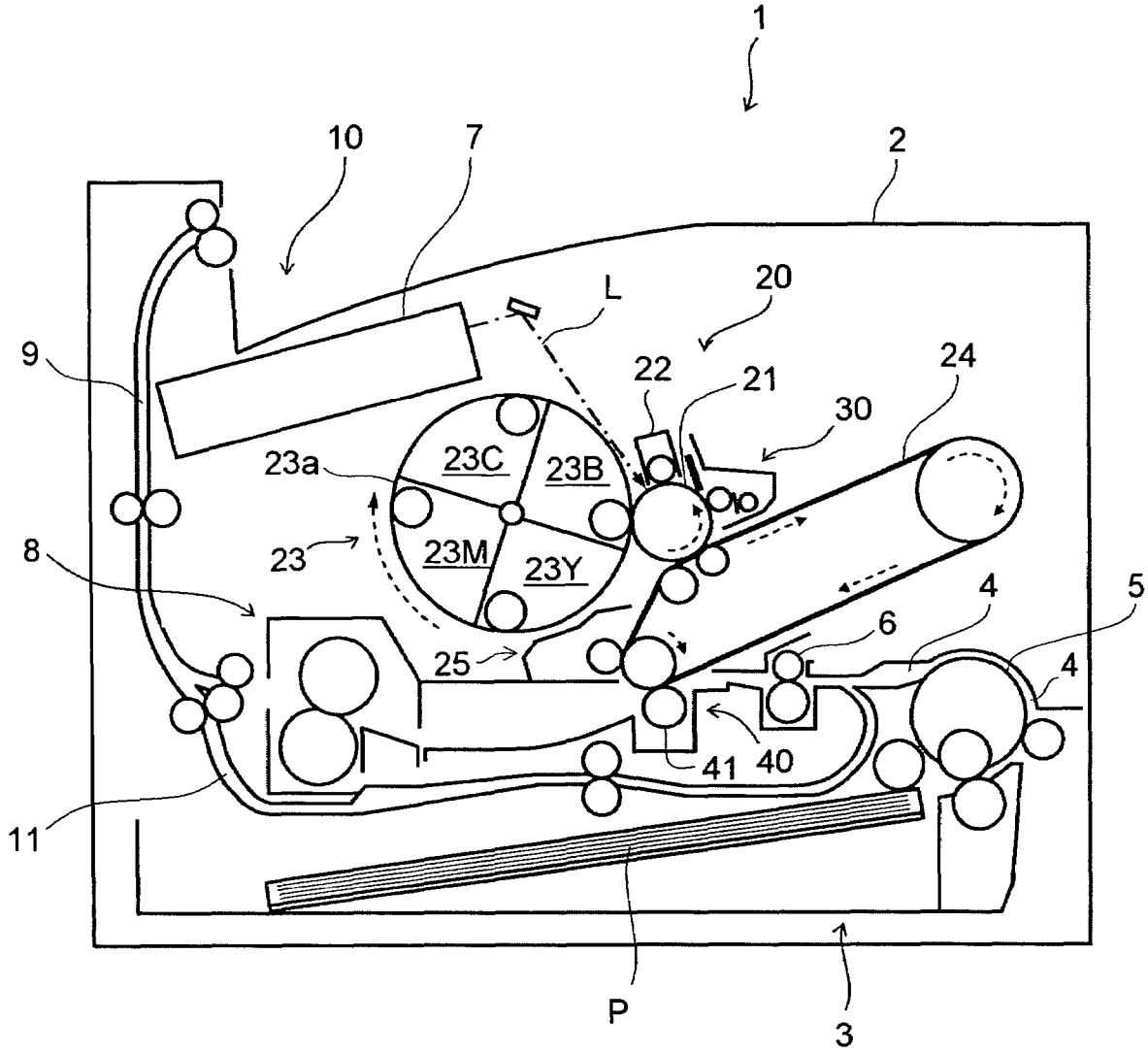
FIG. 1 is a vertically sectional left side view schematically showing the outline structure of a color printer equipped with a cleaning unit according to an embodiment of the present invention.

First, the outline structure of an image forming apparatus equipped with a cleaning unit according to the embodiments of the invention will be described by referring to FIG. 1. FIG. 1 is a vertically sectional left side view schematically showing the outline structure of a color printer, as an example of an image forming apparatus. This color printer is of the type employing an intermediate transfer belt. In FIG. 1, the right hand side corresponds to the front side of the printer while the left hand side corresponds to the back side of the printer.

As shown in FIG. 1, in the inner bottom of a main body 2 of the printer 1, a paper cassette 3 is arranged, into which paper P is sequentially stacked and stored. This paper P is fed toward the top right of the paper cassette 3 as viewed in FIG. 1. The paper cassette 3 can be drawn out horizontally from the front side of the main body 2, i.e., from the right as viewed in FIG. 1.

Arranged downstream of the paper cassette 3 in the paper transport direction are: a paper feed path 4, a paper feed roller 5, a registration roller 6, and an image forming portion 20. The image forming portion 20 includes in its center a photosensitive drum 21, a rotary image carrier. The photosensitive drum 21 rotates counter-clockwise as viewed in FIG. 1. Around the photosensitive drum 21, there are arranged in order along the rotation direction thereof: a charging device 22, a development device 23, and a cleaning unit 30 for the photosensitive drum 21.

The development device 23 is mainly composed of a rotary rack 23*a*, a rotor that rotates clockwise as viewed in FIG. 1. In this rotary rack 23*a*, a total of four development units are so arranged as to be evenly spaced in the circumferential direction. The four development units include: a black development unit 23B, a cyan development unit 23C, a magenta development unit 23M, and a yellow development unit 23Y. The rotary rack 23*a* is rotated by a drive means, not shown, to sequentially transfer the four development units to the position facing the photosensitive drum 21, so that toner images of the respective colors are formed on the surface of the photosensitive drum 21.

Immediately below the photosensitive drum 21, there is arranged an intermediate transfer belt 24, i.e., an intermediate transfer body provided in the form of an endless belt. The intermediate transfer belt 24 is pressed from the bottom into contact with the photosensitive drum 21. The intermediate transfer belt 24 is supported by being wound around a plurality of rollers. The intermediate transfer belt 24 rotates clockwise as viewed in FIG. 1.

At a portion where the intermediate transfer belt 24 is engaged with the paper transport path, there is arranged a secondary transfer portion 40, which includes a secondary transfer roller 41. The paper P is inserted into a nip formed by the pressed contact between these intermediate transfer belt 24 and secondary transfer roller 41. The secondary transfer roller 41 can be shifted in the up and down directions as viewed in FIG. 1, and makes pressed contact with or separates from the intermediate transfer belt 24 as appropriate. Provided downstream of the secondary transfer portion 40 in the paper transport direction is a belt cleaner 25, which also makes pressed contact with or separates from the intermediate belt 24 as appropriate.

Above the image forming portion 20, there is provided an optical portion 7, from which a laser beam L is emitted toward the photosensitive drum 21. In FIG. 1, a dashed line represents the laser beam L.

Arranged downstream of the image forming portion 20 and the secondary transfer portion 40 in the paper transport direction are a fixing portion 8, a paper discharge path 9, and a paper discharge portion 10. The paper discharge portion 10 is located at such a position that permits the paper P already printed out on the top surface of the main body 2 to be taken out from outside.

Below the fixing portion 8 and the secondary transfer portion 40, as well as between these two portions and the paper cassette 3, there is arranged a double-sided printing paper feed transport path 11, which branches off from the paper discharge path 9 and merges with the paper feed path 4 at a position immediately upstream of the registration roller 6.

The printer 1 described above performs the following printing operation. Before subjected to printing, the paper P is stacked and stored in the paper cassette 3, from which each piece of the paper P is separately fed. The fed paper P enters the paper feed path 4, and then is transferred by the paper feed roller 5 to thereby reach the registration roller 6. The registration roller 6, while correcting skew feeding of the paper P, counts down the timing at which a color toner image is formed on the surface of the intermediate transfer belt 24 in the image forming portion 20, and then feeds the paper P to the secondary transfer portion 40.

An external computer, not shown, transmits to the printer 1 a signal on image data such as characters, graphics, and patterns of an original image. Based on this image data, the laser beam L controlled by the optical portion 7 is emitted, whereby an electrostatic latent image of the original image is formed on the surface of the photosensitive drum 21 in the image forming portion 20.

Next, in order to form on the surface of the photosensitive drum 21 a toner image of a black color as a first color among the four different colors, i.e., black, cyan, magenta, and yellow, the rotary rack 23*a* rotates so that the black development unit 23B faces the photosensitive drum 21. The black development unit 23B develops the electrostatic latent image formed on the surface of the photosensitive drum 21 to thereby form a black toner image. Subsequently, the toner image is transferred onto the surface of the intermediate transfer belt 24. After this transfer, the toner remaining on the surface of the photosensitive drum 21 is removed by the cleaning unit 30 for the drum. Then, the same process employed for the first color is repeated for the second to fourth colors, thereby forming on the surface of the intermediate transfer belt 24 a final color toner image in which the toner images of the four colors, i.e., black, cyan, magenta, and yellow, are superimposed on one another.

As described above, while the toner images of the respective colors are primarily transferred in a sequential manner onto the intermediate transfer belt 24, both the secondary transfer roller 41 of the secondary transfer portion 40 and the belt cleaner 25 are separated from the intermediate transfer belt 24. Once the final color toner image of the four colors is formed on the surface of the intermediate transfer belt 24, the secondary transfer roller 41 makes pressed contact with the intermediate transfer belt 24. The final color toner image is transferred onto the paper P, which has been fed in synchronization by the registration roller 6, at the nip formed by the pressed contact between the intermediate transfer belt 24 and the secondary transfer roller 41. In this transfer operation, a transfer bias voltage is applied to the secondary transfer roller 41 so as to transfer the toner onto the paper P.

Subsequently, the paper P carrying the non-fixed final color toner image is fed to the fixing portion 8, where the final color toner image is fixed by a heat roller and a pressure roller. The paper P discharged from the fixing portion 8 is fed upward through the paper discharge path 9 and then discharged to the paper discharge portion 10 provided on the top surface of the main body 2.

In double-sided printing, immediately before the paper P discharged from the fixing portion 8 is discharged to the paper discharge portion 10 through the paper discharge path 9, the transport direction of the paper P is switched, so that the paper P is fed to the double-sided printing paper transport path 11 and then merges with the paper feed path 4 immediately upstream of the registration roller 6, through which the paper P is fed again to the secondary transfer portion 40.

Figure 2:
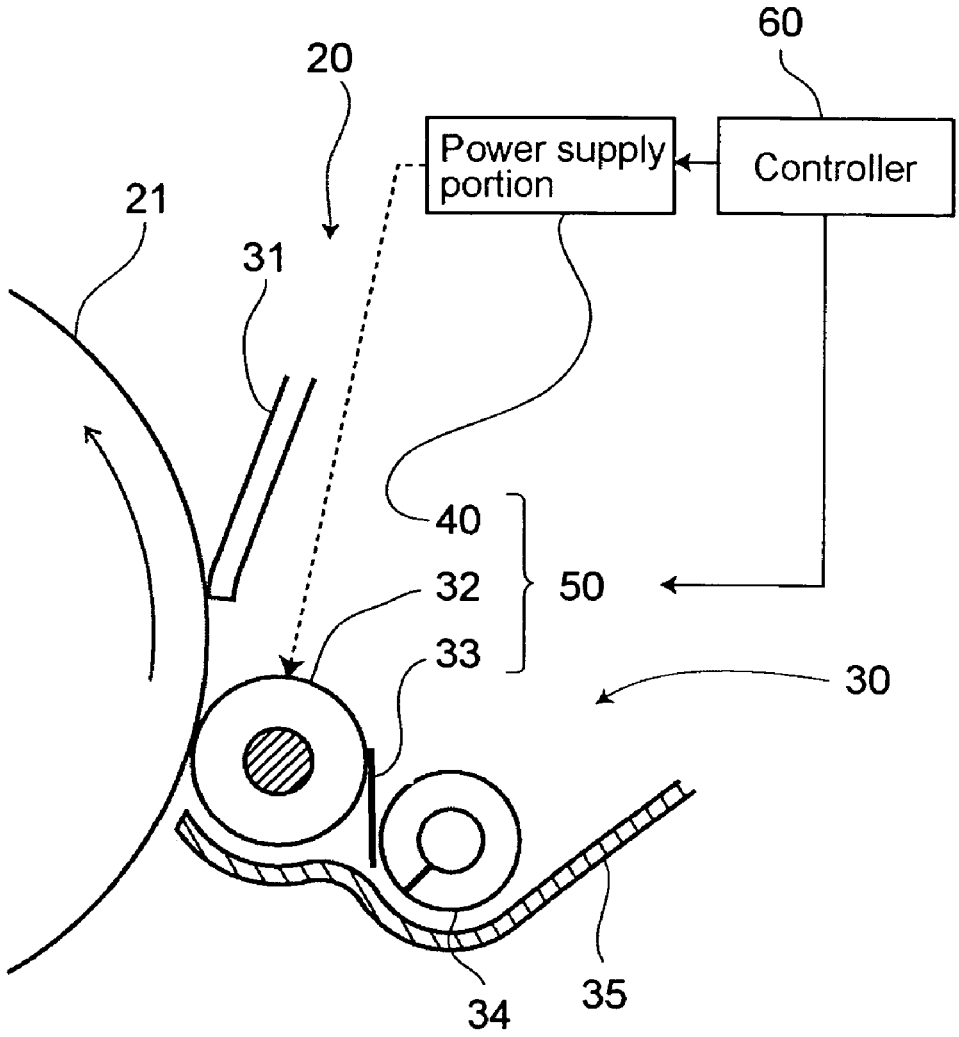
FIG. 2 is a partially enlarged view in a vertical section schematically showing a toner remaining-removing switching means provided to the cleaning unit of the invention, and is a schematic view showing the outline of control.

Next, the detailed structure of the cleaning unit according to the present invention will be described with reference to FIG. 2 in addition to FIG. 1. FIG. 2 is a partially enlarged view in a vertical section schematically showing a toner remaining-removing switching means provided to the cleaning unit, and is a schematic view showing the outline of control.

As shown in FIGS. 1 and 2, the image forming portion 20 includes in its center the photosensitive drum 21 as an image carrier. Near the photosensitive drum 21, there is arranged the cleaning unit 30.

The photosensitive drum 21 is an inorganic photoreceptor formed by providing an amorphous silicon as an inorganic photosensitive material, through vacuum evaporation or the like, on the exterior of a conductive roller-like base substance formed of aluminum or the like, and has a diameter of 30 mm. The photosensitive drum 21 is rotated by a drive means, not shown, such that the circumferential velocity thereof agrees with the paper transport speed (150 mm/s).

The cleaning unit 30 for the photosensitive drum 21 is arranged still more downstream of a primary transfer nip portion along the rotation direction of the photosensitive drum 21 (see FIG. 1). As shown in FIG. 2, the cleaning unit 30 includes: a cleaning blade 31; a cleaning roller 32 as a rotary member; a scraper 33; a screw 34; and a housing 35.

The cleaning blade 31 is formed of a urethane rubber having a hardness of 77 degrees (based on JIS Standard A), has an axial length substantially equal to that of the photosensitive drum 21 and a thickness of 2.2 mm, and is in contact with the photosensitive drum 21. The cleaning blade 31 is provided with respect to the photosensitive drum 21 such that the angle formed by the tangent and the contact area becomes 26 degrees and the linear pressure of the contact area becomes 30 N/m. How this cleaning blade 31 is arranged will be described later. The cleaning blade 31 performs cleaning in such a manner as to scrape off an adherent such as a toner remaining on the surface of the photosensitive drum 21.

The cleaning roller 32 is formed by providing an ethylene propylene rubber (EPDM) having a hardness of 55 degrees (based on JIS Standard A) around a core metal having a diameter of 8 mm, and has a roller portion with a diameter of 12 mm. The cleaning roller 32 is so provided as to be pressed against the photosensitive drum 21 with a force of 1,000 gf (500 gf for one side) by a pressing means, not shown, that is provided at both ends of the shaft of the cleaning roller 32. The cleaning roller 32 plays roles in collecting a toner remaining on the surface of the photosensitive drum 21 and around the cleaning blade 31 and feeding the collected toner to the screw 34.

Performing cleaning efficiently requires rotation of the cleaning roller 32 at a predetermined surface speed. When the surface of the cleaning roller 32 at the area in contact with the photosensitive drum 21 is rotated in the direction opposite to the moving direction of the surface of the photosensitive drum 21, the surface speed of the cleaning roller 32 is 1.2 times that of the photosensitive drum 21. When the surface of the cleaning roller 32 at the area in contact with the photosensitive drum 21 is rotated in the same direction as the moving direction of the surface of the photosensitive drum 21, the surface speed of the cleaning roller 32 is 0.8 times that of the photosensitive drum 21.

The scraper 33 is formed of a stainless plate having a thickness of 0.08 mm, and has an axial length substantially equal to that of the cleaning roller 32. The scraper 33 typically makes contact with the cleaning roller 32 to help feeding a toner removed from the surface of the cleaning roller 32 toward the screw 34.

More specifically, after a toner image is transferred onto the intermediate transfer belt 24 (see FIG. 1), the toner remaining on the photosensitive drum 21 is scraped off by the cleaning blade 31 and then adheres to the cleaning roller 32, or the remaining toner directly moves to the cleaning roller 32. The toner adhering to the cleaning roller 32 drops near the screw 34 under its own weight, or is fed through the scraper 33 to the screw 34, by which the toner is carried out of the housing 35.

A power supply portion 40 is controlled by a controller 60, and is used upon application of a bias voltage to the cleaning roller 32, as described later.

In the present invention, the rotation direction of the cleaning roller 32, the position of the scraper 33, or the bias voltage applied to the cleaning roller 32 through the power supply portion 40, or these in combination are controlled by the controller 60 as a toner remaining-removing switching means 50. Such a control permits a toner to remain at the region between the cleaning blade 31 and the cleaning roller 32 near the photosensitive drum 21 and to be removed.

Now, a description will be given on a toner used as a developer for image formation. An amorphous toner was used for the black toner stored in the black development unit 23B of the rotary rack 23*a* shown in FIG. 1; spherical toners were used as the cyan toner, the magenta toner, and the yellow toner stored in the color development units 23C, 23M, and 23Y, respectively.

The black amorphous toner was produced in the following method. First, a polyester resin was mixed with 5 parts by weight (with the weight of the polyester resin defined as 100) of a carbon black and nigrosin N21 (manufactured by Orient Chemical Industries Ltd.) as a charge control agent (CCA), and then kneaded with two roll kneaders at 100 degrees Celsius for 30 minutes. Then, this mixture was first subjected to coarse pulverizing, and then to fine pulverizing with a jet stream pulverizer provided in a collision plate method. Subsequently, the mixture was classified by a pneumatic classifier, whereby fine particles having a volume-weighted mean diameter of 7.8 μm were obtained. Adding 1.5 parts by weight of a hydrophobic silica powder to the fine particles and mixing them together with a powder mixer can provide an amorphous toner. The charge amount achieved by the suction method was +12 μC/g. The sphericity of this amorphous toner was 0.91 to 0.93 as measured by a flow-type particle image analyzer manufactured by Sysmex Corporation.

The spherical toners of the three colors are produced in the following method. First, 2 parts by weight of a polymerization initiator and 2 parts by weight of 2-azobis (2-, 4-dimethyl valeronitrile) are added to a mixed solution containing: 80 parts by weight of styrene, 20 parts by weight of 2-ethylhexyl methacrylate, 5 parts by weight of a colorant, 3 parts by weight of low-molecular-weight polypropylene, 2 parts by weight of a charge control agent (quaternary ammonium salt), and 1 part by weight of divinylbenzene (a cross-linking agent). This is then added to 400 parts by weight of purified water, to which 5 parts by weight of calcium phosphate and 0.1 part by weight of sodium dodecylbenzenesulfonate are added as suspension stabilizers. Subsequently, the mixture is stirred with a formulating-dispersing machine manufactured by TOKUSHU KIKAI KOGYO CO., LTD. at a rotation speed of 700 rpm for 20 minutes, and causes a polymerization reaction at 70 degrees Celsius and 100 rpm for 10 minutes to thereby obtain a spherical toner having a volume-weighted mean diameter of 6.4 μm. The charge amounts provided by a suction method for the three color toners are: +33 μC/g for cyan, +29 μC/g for magenta, and +32 μC/g for yellow. The sphericity of these spherical toners was 0.96 to 0.99 as measured by the flow-type particle image analyzer manufactured by Sysmex Corporation.

Figure 3:
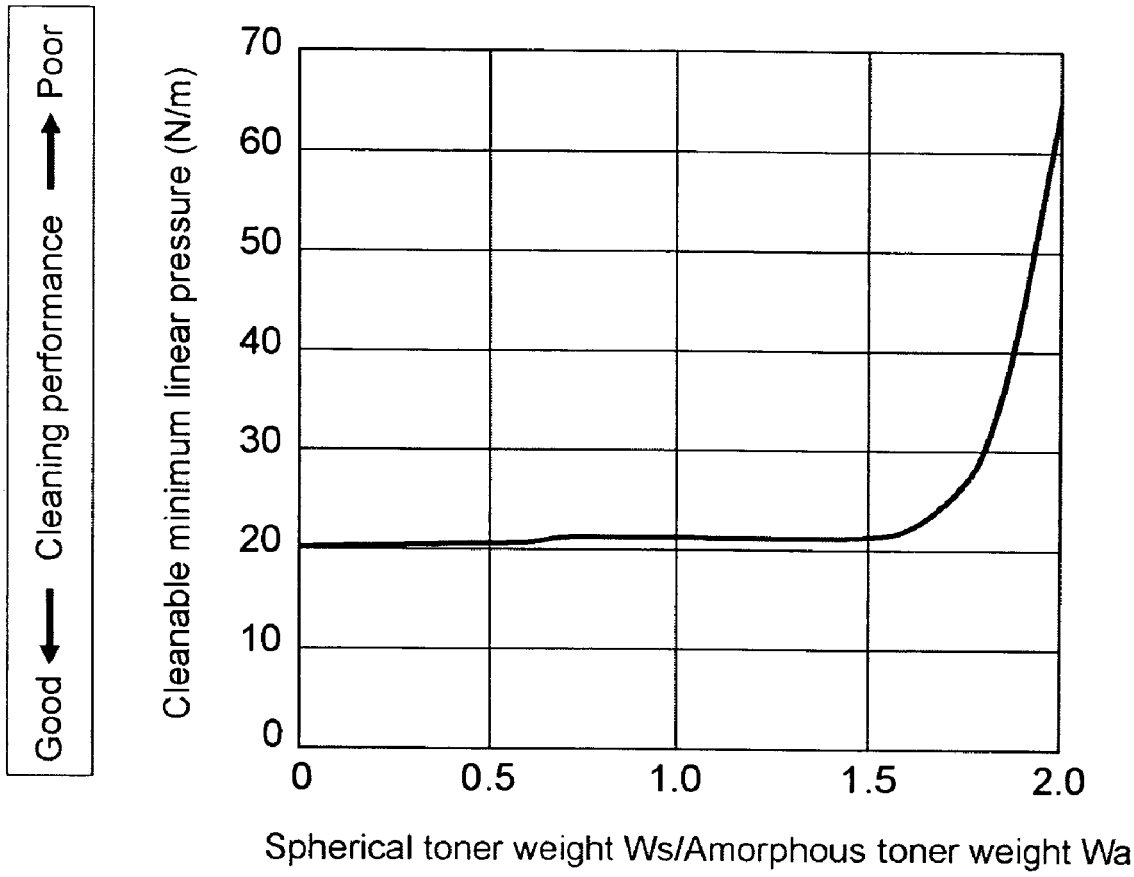
FIG. 3 is graph showing how the weight ratio of an amorphous toner with respect to a spherical toner has an effect on the cleanable minimum linear pressure.

How the cleaning blade 31 and the cleaning roller 32 are arranged in the cleaning unit 30 configured as described above will be described below, referring to FIG. 3. FIG. 3 is a graph showing how the weight ratio of the spherical toner with respect to the amorphous toner has an effect on the cleanable minimum linear pressure.

First, the cleanable minimum linear pressure provided by the cleaning blade 31 was judged, referring to a case where only the amorphous black toner was used. This judgment was made by visually checking the paper surface for any paper region left not cleaned by the cleaning blade 31 after development of an image formed by one full circumference of the photosensitive drum 21 without any gaps, cleaning performed by the cleaning blade 31, and transferring of the image onto paper. A paper surface identified as having an even slight amount of toner is judged as a surface insufficiently cleaned. As a result, the cleanable minimum liner pressure provided by the cleaning blade 31 was 20 N/m. At this point, the cleaning roller 32 is arranged in such a manner as to be pressed against the photosensitive drum 21 with a force of 1,000 gf, as described above.

Then, as shown in FIG. 3, the cleanable minimum linear pressure was judged when the weight of the spherical toner for the different colors is gradually increased starting with the condition where only the amorphous toner is used. In FIG. 3, the horizontal axis indicates the ratio of the spherical toner weight Ws with respect to the amorphous toner weight Wa. The toner weight is equal between the two types of toners at 1.00, and the spherical toner weight becomes increasingly larger toward the right. The vertical axis indicates the cleanable minimum linear pressure provided by the cleaning blade 31. The required linear pressure becomes increasingly higher toward the top. That is, the cleaning blade 31 needs to be pressed against the photosensitive drum 21 with an increasingly greater force as the indication on the vertical axis goes upward; therefore, a cleaning performance becomes increasingly poorer as the indication goes upward while becoming increasingly better as the indication goes downward.

FIG. 3 shows that, in the processes for all the colors, when the relationship between the spherical toner weight Ws and the amorphous toner weight Wa remaining at the region between the cleaning blade 31 and the cleaning roller 32 near the surface of the photosensitive drum 21 exceeds (Ws/Wa)<1.5, the cleanable minimum linear pressure gradually increases. That is, an increase in the spherical toner exceeding (Ws/Wa)<1.5 results in a poor cleaning performance.

Generally speaking, the spherical toner typically has a high transfer efficiency, and thus the weight of the spherical toner remaining on the surface of the photosensitive drum 21 is 5% or below (approximately 4% in this experiment) of the weight of the toner supplied (developing toner weight). On the other hand, the weight of the amorphous toner remaining on the surface of the photosensitive drum 21 is 10% to 20% (approximately 18% in this experiment) of the weight of the toner supplied. When all the toners of the four colors are, after transferred, made to remain at the region between the cleaning blade 31 and the cleaning roller 32 near the photosensitive drum 21 until the end of the image formation, assuming that the remaining amount of the black amorphous toner is the minimum amount (10%) while the remaining amounts of the spherical toners of the three colors are each the maximum amount (3×5%), the relationship between the spherical toner weight Ws and the amorphous toner weight Wa is approximately (Ws/Wa)=1.5

Therefore, the cleaning blade 31, the cleaning roller 32, and the scraper 33 are arranged in the cleaning unit 30 of the invention with respect to the photosensitive drum 21 such that, in the processes for all the colors, the relationship between the spherical toner weight Ws and the amorphous toner weight Wa remaining at the region between the cleaning blade 31 and the cleaning roller 32 near the surface of the photosensitive drum 21 becomes (Ws/Wa)<1.5.

In the above experiment, the weight of the developing toner supplied to the photosensitive drum 21 was 0.60 $mg/cm^2$ for the amorphous toner and 0.52 $mg/cm^2$ for the spherical toner. The relationship between the spherical toner weight Ws and the amorphous toner weight Wa can be kept (Ws/Wa)<1.5 by varying the transfer efficiency, the development condition, or the like.

Next, based on embodiments of the present invention, a description will be given below concerning how the behavior of a toner remaining on the surface of the photosensitive drum 21 is affected by the operation of the toner remaining-removing switching means 50 based on the rotation direction of the cleaning roller 32, the position of the scraper 33, or the bias voltage applied to the cleaning roller 32 through the power supply portion 40, or these in combination.

Figure 4:
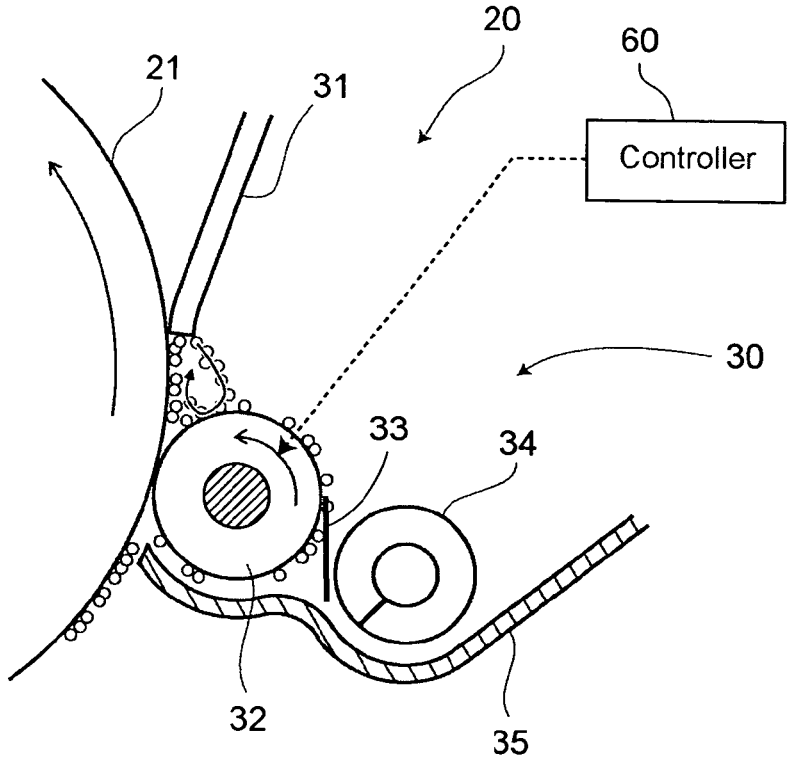
FIG. 4 is a partially enlarged view in a vertical section schematically showing the surrounding of the cleaning unit, with the surface of a cleaning roller rotated in the direction opposite to the moving direction of the surface of a photosensitive drum.
Figure 5:
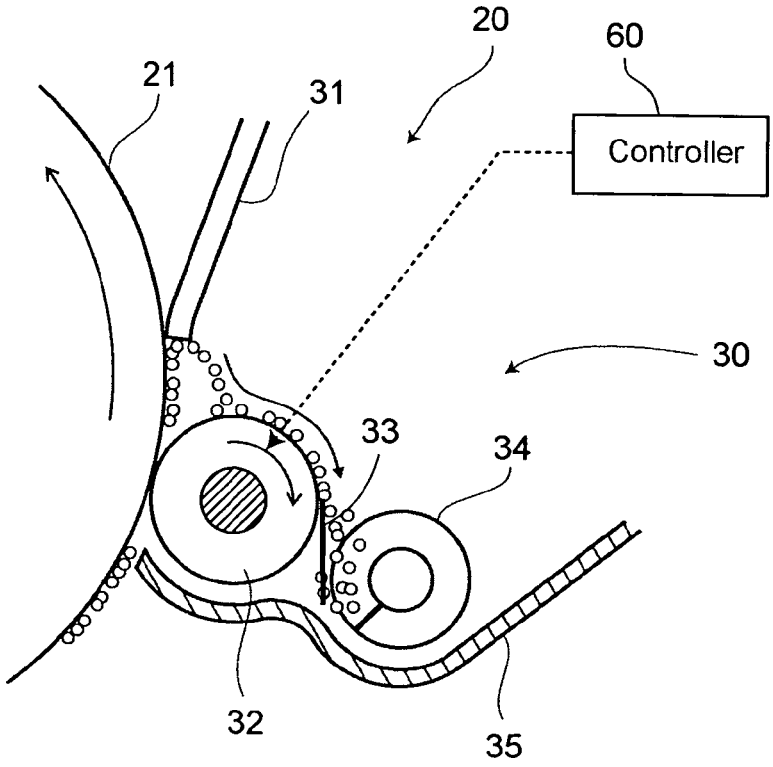
FIG. 5 is similar to FIG. 4, but with the surface of the cleaning roller rotated in the same direction as the moving direction of the surface of the photosensitive drum.

In the first to third embodiments, toner remaining-removing switching is made by changing the rotation method of the cleaning roller 32. In these embodiments, the scraper 33 is fixed in contact with the cleaning roller 32. A bias voltage is not applied to the cleaning roller 32, or an appropriate bias voltage for cleaning is applied thereto, but its value is fixed. FIG. 4 is a partially enlarged view in a vertical section schematically showing the surrounding of the cleaning unit, with the surface of the cleaning roller 32 rotated in the direction opposite to the moving direction of the surface of the photosensitive drum 21. FIG. 5 is similar to FIG. 4 but with the surface of the cleaning roller 32 rotated in the same direction as the moving direction of the surface of the photosensitive drum 21.

As shown in FIG. 4, when the surface of the cleaning roller 32 at the area in contact with the photosensitive drum 21 is rotated in the direction opposite to the moving direction of the surface of the photosensitive drum 21, a toner scraped off the surface of the photosensitive drum 21 by the cleaning blade 31 drops on the cleaning roller 32, thus adhering again to the surface of the photosensitive drum 21. Moreover, a toner adhering from the surface of the photosensitive drum 21 directly to the cleaning roller 32 also adheres again to the surface of the photosensitive drum 21 near the cleaning blade 31. In this way, the toner cleaned off the surface of the photosensitive drum 21 is not fed toward the screw 34 and thus remains at the region between the cleaning blade 31 and the cleaning roller 32 near the photosensitive drum 21.

Next, as shown in FIG. 5, when the surface of the cleaning roller 32 at the region in contact with the photosensitive drum 21 is rotated in the same direction as the moving direction of the surface of the photosensitive drum 21, a toner scraped off the surface of the photosensitive drum 21 by the cleaning blade 31 and a toner adhering from the surface of the photosensitive drum 21 directly to the cleaning roller 32 are fed toward the screw 34 under the action of gravity, guided by the rotation of the cleaning roller 32, and under the guidance of the scraper 33, and then are carried out of the housing 35 by the screw 34.

Figure 6:
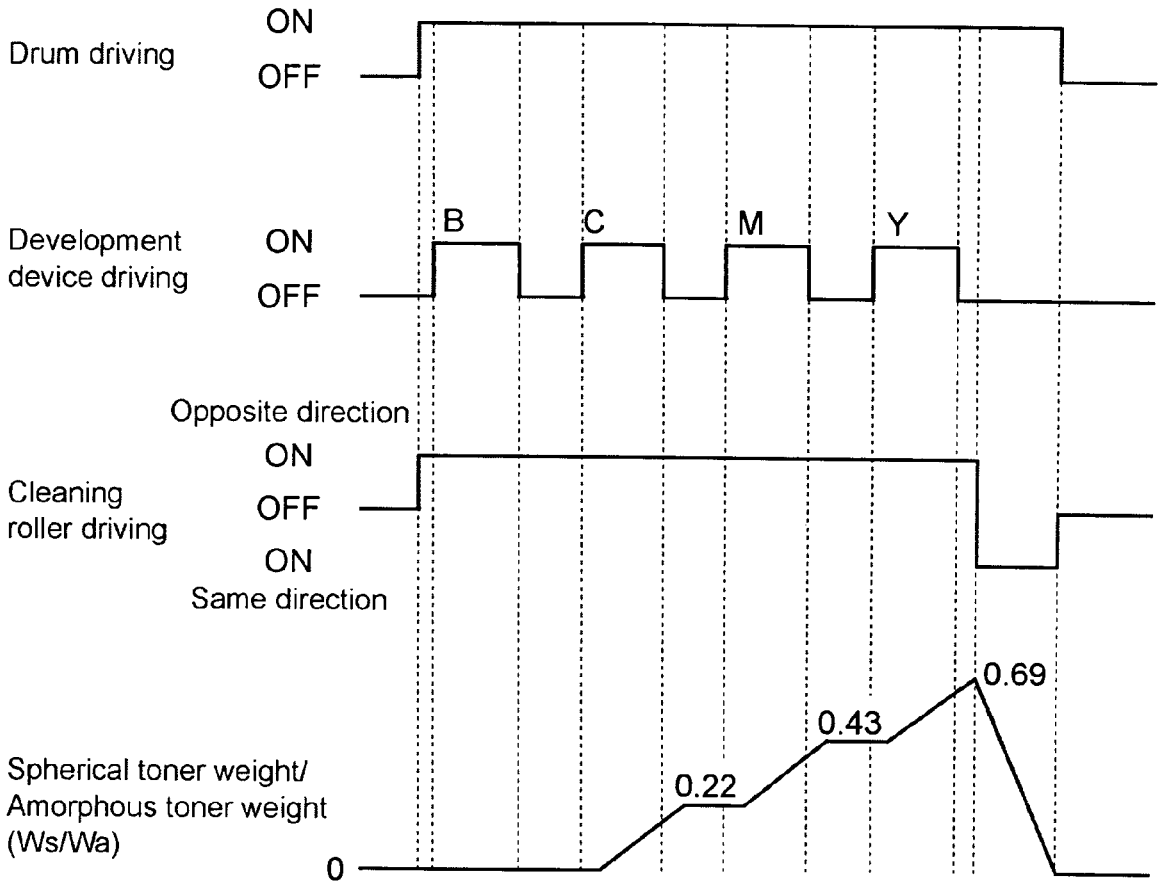
FIG. 6 is a chart of the control performed by a cleaning unit according to a first embodiment, with a graph showing a change in the weight ratio of the spherical toner with respect to the amorphous toner.

Next, the first embodiment of the present invention will be described, referring to FIG. 6 in addition to FIGS. 1, 4, and 5. FIG. 6 is a chart of the control performed by the cleaning unit during cleaning, with a graph showing a change in the weight ratio of the spherical toner with respect to the amorphous toner.

For the driving method of the cleaning roller 32, "opposite direction ON" indicates a case where the surface of the cleaning roller 32 at the area in contact with the photosensitive drum 21 is rotated in the direction opposite to the moving direction of the surface of the photosensitive drum 21, "Same direction ON" indicates a case where the surface of the cleaning roller 32 at the area in contact with the photosensitive drum 21 is rotated in the same direction as the moving direction of the surface of the photosensitive drum 21, and "OFF" indicates a case where the cleaning roller 32 is rotated to follow the rotation of the photosensitive drum 21. For the change in the weight ratio of a spherical toner and an amorphous toner is indicated by "Spherical toner weight/amorphous toner weight (Ws/Wa)" in correspondence with FIG. 3. After sampling toners around the cleaning blade 31 at a predetermined timing while the development units, the cleaning roller 32, and the like are driven, the weight ratio of the toners remaining at the region between the cleaning blade 31 and the cleaning roller 32 near the photosensitive drum 21 is measured by use of a scanning electron microscope (SEM).

As shown in FIG. 6, in the image forming operation performed on the photosensitive drum 21, the photosensitive drum 21 starts to rotate, and then the four development units, black development unit 23B, cyan development unit 23C, magenta development unit 23M and yellow development unit 23Y are sequentially driven, whereby a color toner image is formed on the surface of the intermediate belt 24 (see FIG. 1).

During the image forming operation, the surface of the cleaning roller 32 at the area in contact with the photosensitive drum 21 is rotated by the controller 60 in the direction opposite to the moving direction of the surface of the photosensitive drum 21 (see FIG. 4), whereby the four color toners remain around the cleaning roller 32 and the cleaning blade 31 until immediately before the end of the image forming operation. The ratio of the spherical toner weight with respect to the amorphous toner weight increases accordingly as the cyan, magenta, and yellow color toners are developed, reaching a maximum of 0.69, but maintaining below 1.5, immediately before the end of the image forming operation.

Upon completion of developing all the four colors, the surface of the cleaning roller 32 at the area in contact with the photosensitive drum 21 is rotated by the controller 60 in the same direction as the moving direction of the surface of the photosensitive drum 21 (see FIG. 5). All the four color toners are fed toward the screw 34 under the action of gravity, guided by the rotation of the cleaning roller 32, and under the guidance of the scraper 33, and then are carried out of the housing 35 by the screw 34. Through such a cleaning operation, the spherical toner is removed together with the amorphous toner from the surface of the photosensitive drum 21.

Figure 7:
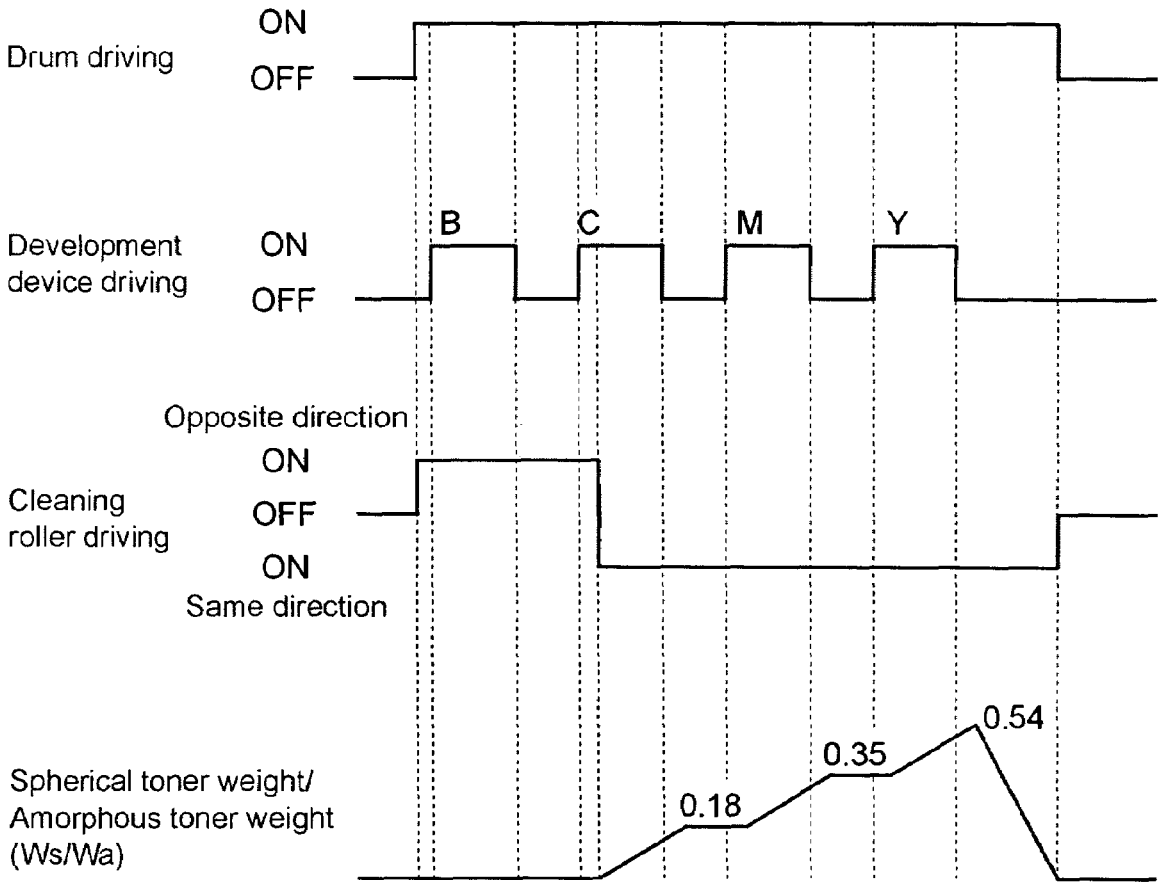
FIG. 7 is a chart of the control performed by a cleaning unit according to a second embodiment, with a graph showing a change in the weight ratio of the spherical toner with respect to the amorphous toner.

Next, modification of the cleaning operation performed by the cleaning unit 30 in the first embodiment will be described as a second embodiment of the invention, referring to FIG. 7 in addition to FIGS. 1, 4, and 5. FIG. 7 is a chart of the control performed by the cleaning unit during cleaning, with a graph showing a change in the weight ratio of the spherical toner with respect to the amorphous toner. The construction of the cleaning unit of this embodiment is the same as that of the first embodiment; therefore, its indication on the drawings and its description will be omitted. The drawing method employed for FIG. 7 is the same as that for FIG. 6.

As shown in FIG. 7, in the image forming operation performed on the photosensitive drum 21, the photosensitive drum 21 starts to rotate, and subsequently development of the first color, i.e., black, starts. Upon the cleaning of the black toner, i.e., amorphous toner, the surface of the cleaning roller 32 at the area in contact with the photosensitive drum 21 is rotated by the controller 60 in the direction opposite to the moving direction of the surface of the photosensitive drum 21 (see FIG. 4), whereby the black toner remains at the region between the cleaning roller 32 and the cleaning blade 31 near the photosensitive drum 21 until the three color toners, i.e., spherical toners, start to be cleaned.

When the development of the cyan color, the first color of the three colors, is started after the development of the black toner is completed, in order to clean the cyan toner, the surface of the cleaning roller 32 at the area in contact with the photosensitive drum 21 is rotated by the controller 60 in the same direction as the moving direction of the surface of the photosensitive drum 21 (see FIG. 5). Then, the development and cleaning of the spherical toners, magenta and yellow, continues sequentially. The spherical toners of the different colors are sequentially fed together with the black toner toward the screw 34 under the action of gravity, guided by the rotation of the cleaning roller 32, and under the guidance of the scraper 33, and then are carried out of the housing 35 by the screw 34. The ratio of the spherical toner weight with respect to the amorphous toner weight increases accordingly as the cyan, magenta, and yellow color toners are developed sequentially, reaching a maximum of 0.54, but maintaining below 1.5, immediately before the end of the image forming operation. When the image forming operation is completed, all the four colors have been cleaned, so that the spherical toners are removed, together with the amorphous toner, from the surface of the photosensitive drum 21.

FIG. 7 refers to an example of control such that a toner remains during the cleaning of the amorphous black toner while a cleaned toner is removed from the aforementioned region during the period from the cleaning of the next spherical cyan toner to the end of the image forming operation. As alternative control, though not shown, a toner may remain during the cleaning of the black toner and the cleaning of the cyan toner while a toner may be removed from the aforementioned region during the period from the cleaning of the magenta toner to the end of image forming operation. Even in such a case, the measurement showed that the ratio of the spherical toner weight to the amorphous toner weight is kept 1.5 or below. Control such that the black, cyan, and magenta toners remain during their cleaning operations while the yellow toner is removed from the aforementioned region during its cleaning operation provides the same results as shown in the example of FIG. 6.

Figure 8:
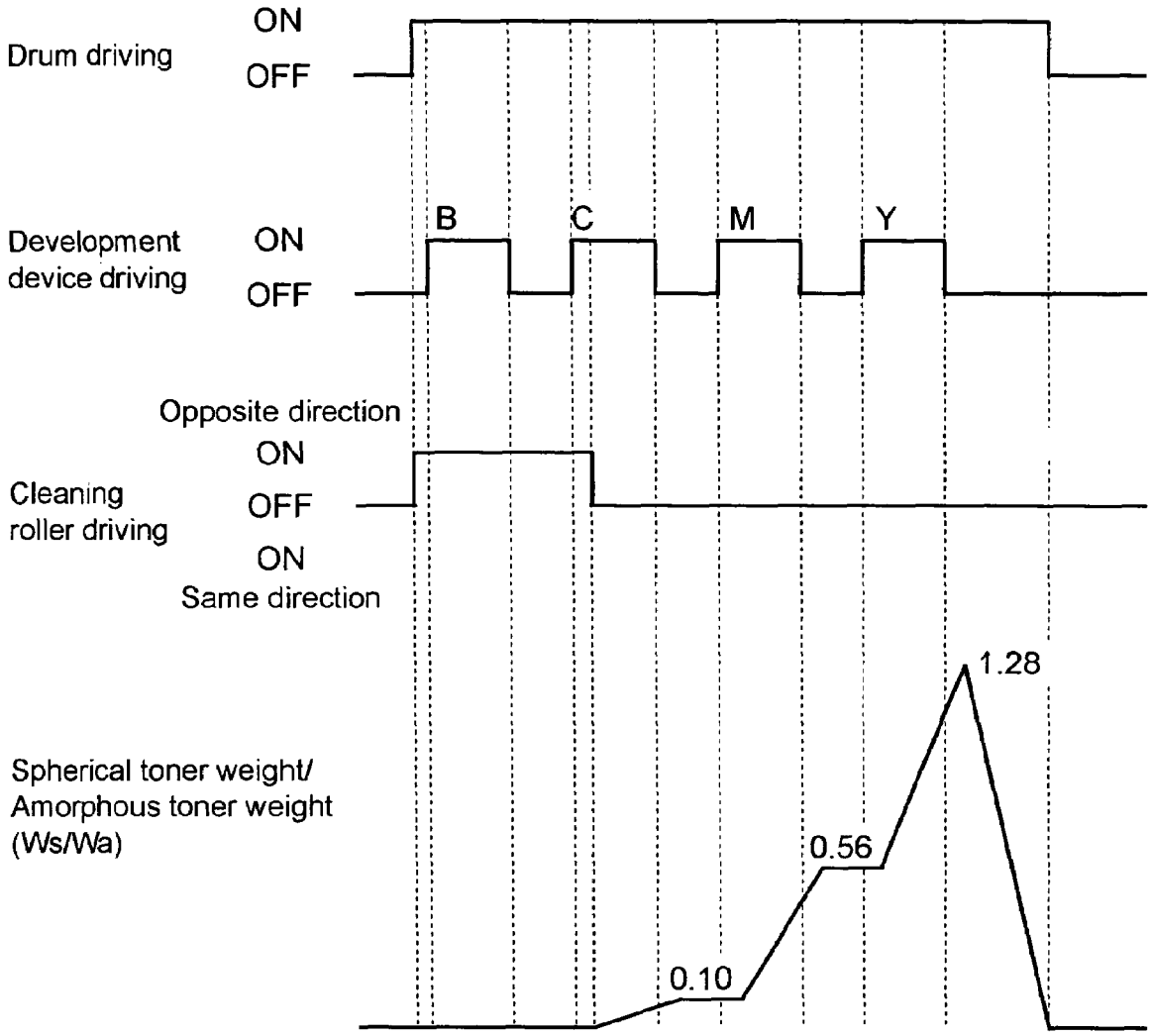
FIG. 8 is a chart of the control performed by a cleaning unit according to a third embodiment, with a graph showing a change in the weight ratio of the spherical toner with respect to the amorphous toner.

Next, modification of the cleaning operation performed by the cleaning unit 30 in the first and second embodiments will be described as a third embodiment of the invention, referring to FIG. 8 in addition to FIGS. 1, 4, and 5. FIG. 8 is a chart of the control performed by the cleaning unit during cleaning, with a graph showing a change in the weight ratio of the spherical toner with respect to the amorphous toner. The construction of the cleaning unit of this embodiment is the same as that of the first embodiment; therefore, its indication on the drawings and its description will be omitted. The drawing method employed for FIG. 8 is the same as that for FIG. 6.

As shown in FIG. 8, in the image forming operation performed on the photosensitive drum 21, the photosensitive drum 21 starts to rotate, and subsequently development of the first color, i.e., black, starts. Upon the cleaning of the black toner, i.e., amorphous toner, the surface of the cleaning roller 32 at the area in contact with the photosensitive drum 21 is rotated by the controller 60 in the direction opposite to the moving direction of the surface of the photosensitive drum 21 (see FIG. 4).

When the development of the cyan color, the first color of the three colors, is started after the development of the black toner is completed, the cleaning roller 32 is controlled by the controller 60 to rotate in accordance with the rotation of the photosensitive drum 21 (see FIG. 5). The ratio of the spherical toner weight with respect to the amorphous toner weight increases accordingly as the cyan, magenta, and yellow color toners are developed sequentially, reaching a maximum of 1.28, but maintaining below 1.5, immediately before the end of the image forming operation. When the image forming operation is completed, all the four colors have been cleaned, so that the spherical toners are removed together with the amorphous toner from the surface of the photosensitive drum 21.

Figure 9:
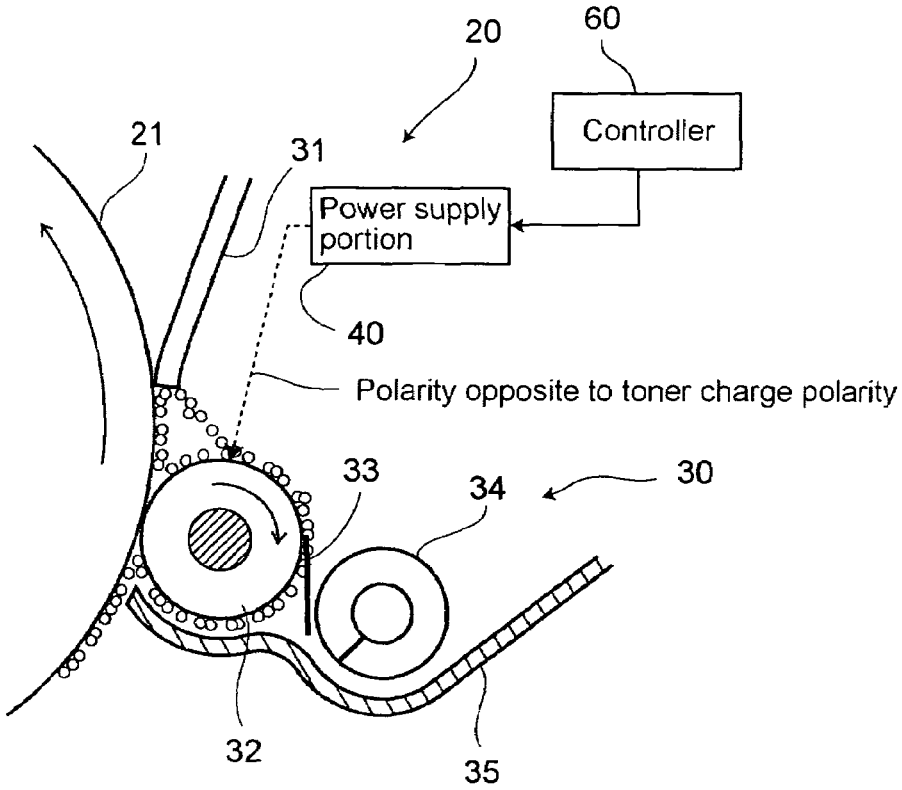
FIG. 9 is a partially enlarged view in a vertical section schematically showing the surrounding of the cleaning unit, with a bias voltage, opposite in polarity to the charge potential of a toner, being applied to the cleaning roller.
Figure 10:
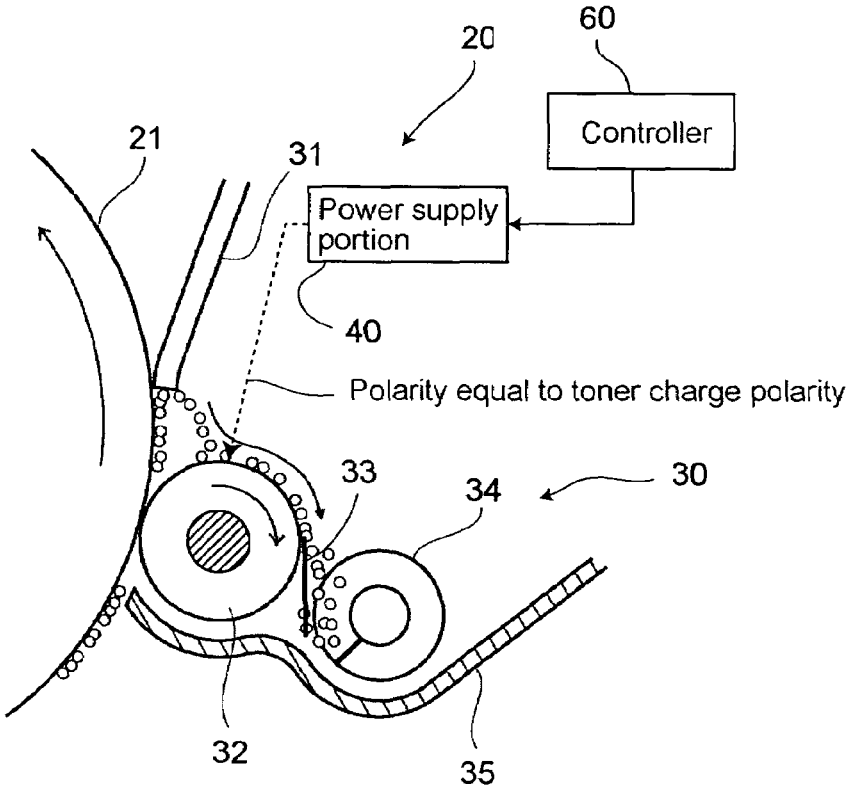
FIG. 10 is a partially enlarged view in a vertical section schematically showing the surrounding of the cleaning unit, with a bias voltage, equal in polarity to the charge potential of a toner, being applied to the cleaning roller.

Next, referring to FIGS. 9 and 10 in addition to FIG. 1, a description will be given on a fourth and a fifth embodiments in which toner remaining-removing switching is made by the application of a bias voltage to the cleaning roller 32 composing the toner remaining-removing switching means 50. FIG. 9 is a partially enlarged view in a vertical section schematically showing the surrounding of the cleaning unit, with a bias voltage, opposite in polarity to the charge potential of a toner, being applied to the cleaning roller. FIG. 10 is a drawing similar to FIG. 9, but with a bias voltage, equal in polarity to the charge potential of a toner, being applied to the cleaning roller. In these embodiments, the surface of the cleaning roller 32 at the area in contact with the photosensitive drum 21 rotates in the same direction as the moving direction of the surface of the photosensitive drum 21, and thus this rotation direction does not change at later times. The scraper 33 is fixed in contact with the cleaning roller 32.

The bias voltage is 350V when it is opposite in polarity to the charge potential of a toner, and 900V when it is equal in polarity to the charge potential of a toner. Additionally superimposing AC voltage on DC voltage improves efficiency in permitting a toner to remain around the cleaning roller 32 or to be fed toward the screw 34. Thus, especially when the bias voltage is equal in polarity to the charge potential of a toner, the period from when the last development operation is completed to when the cleaning roller 32 stops can be reduced. The bias voltage applied during the cleaning operation can be switched by the controller 60 by controlling the power supply portion 40.

As shown in FIG. 9, when a bias voltage opposite in polarity to the charge potential of a toner is applied to the cleaning roller 32, the cleaning roller 32 and the toner attract each other, so that the toner scraped off the surface of the photosensitive drum 21 by the cleaning blade 31 tends to drop on the cleaning roller 32 and adheres again to the surface of the photosensitive drum 21. In addition, due to the bias voltage opposite in polarity, the toner adhering directly from the surface of the photosensitive drum 21 to the cleaning roller 32 never separates from the surface of the cleaning roller 32 even through the scraper 33 is in contact with the surface of the cleaning roller 32. Thus, even when the surface of the cleaning roller 32 at the area in contact with the photosensitive drum 21 rotates in the same direction as the moving direction of the surface of the photosensitive drum 21, the toner cleaned off the surface of the photosensitive drum 21 is forced, under strong influence of the bias voltage, to remain around the cleaning roller 32 without being fed toward the screw 34.

Next, as shown in FIG. 10, when a bias voltage equal in polarity to the charge potential of a toner is applied, the cleaning roller 32 and the toner repel each other, so that the toner scraped off the surface of the photosensitive drum 21 by the cleaning blade 31 and the toner adhering directly from the surface of the photosensitive drum 21 to the cleaning roller 32 are fed toward the screw 34 under the action of gravity, guided by the rotation of the cleaning roller 32, and under the guidance of the scraper 33, and then are carried out of the housing 35 by the screw 34.

Figure 11:
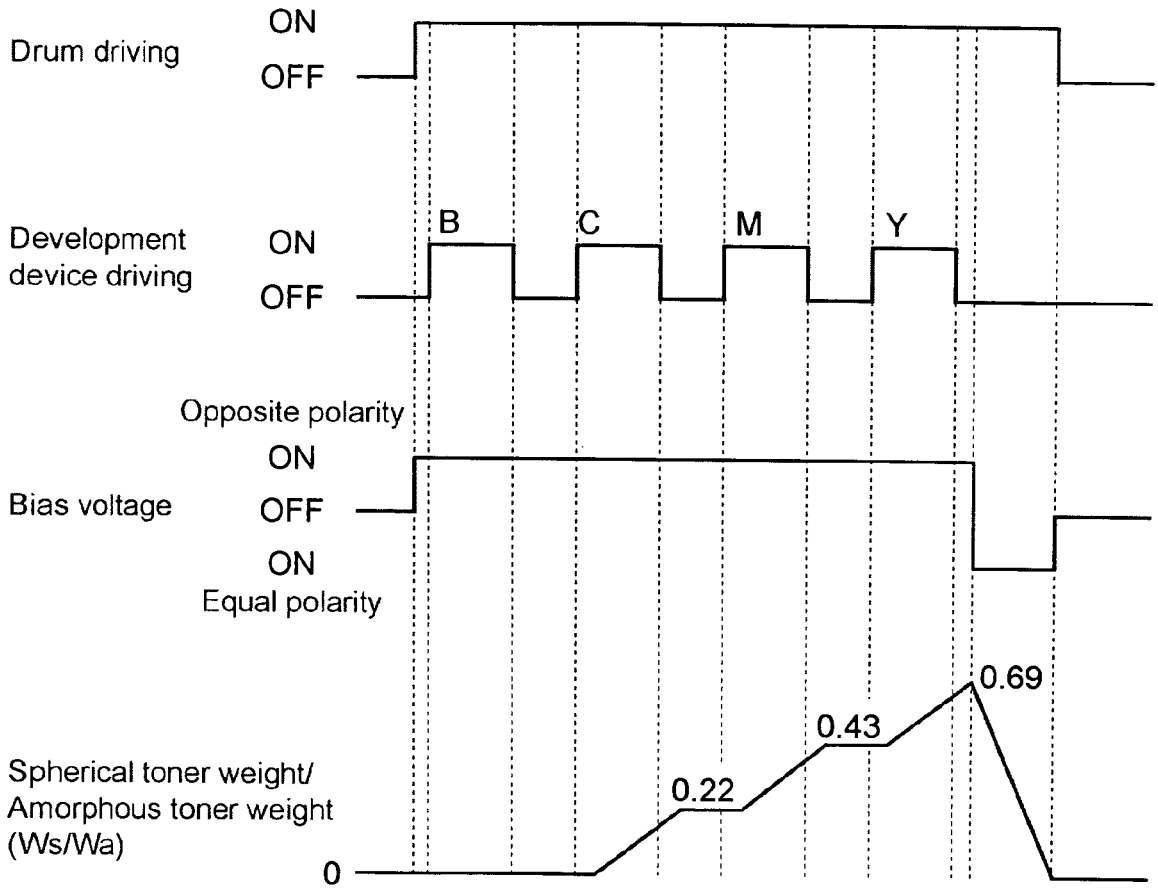
FIG. 11 is a chart of the control performed by a cleaning unit according to a fourth embodiment, with a graph showing a change in the weight ratio of the spherical toner with respect to the amorphous toner.

Next, the fourth embodiment will be described, referring to FIG. 11 in addition to FIGS. 1, 9, and 10. FIG. 11 is a chart of the control performed by the cleaning unit during cleaning, with a graph showing a change in the weight ratio of the spherical toner with respect to the amorphous toner. The drawing method employed for FIG. 11 is basically the same as that for FIG. 6 used for the description of the first embodiment, except for that the control of the bias voltage applied to the cleaning roller 32, instead of the control of the rotation of the cleaning roller 32, is indicated in chart.

As shown in FIG. 11, in the image forming operation performed on the photosensitive drum 21, the photosensitive drum 21 starts to rotate, and subsequently the four development units, the black development unit 23B, the cyan development unit 23C, the magenta development unit 23M, and the yellow development unit 23Y, are sequentially driven and then a color toner image is formed on the surface of the intermediate transfer belt 24 (see FIG. 1).

During the image forming operation, the power supply portion 40 is controlled by the controller 60 to apply to the cleaning roller 32 a bias voltage opposite in polarity to the charge potential of a toner (see FIG. 9). As a result, the four color toners are attracted to the cleaning roller 32 and remain at the region between the cleaning blade 31 and the cleaning roller 32 near the photosensitive drum 21 until immediately before the end of the image forming operation. The ratio of the spherical toner weight with respect to the amorphous toner weight increases accordingly as the cyan, magenta, and yellow color toners are developed sequentially, reaching a maximum of 0.69, but maintaining below 1.5, immediately before the end of the image forming operation.

When the development of all the four colors is completed, the supply power portion 40 is controlled by the controller 60 to apply to the cleaning roller 32 a bias voltage equal in polarity to the charge potential of a toner (see FIG. 10). All the four color toners repel the cleaning roller 32, and are fed toward the screw 34 under the action of gravity, guided by the rotation of the cleaning roller 32, and under the guidance of the scraper 33, and then are carried out of the housing 35 by the screw 34. Such a cleaning operation permits the spherical toners to be removed together with the amorphous toner from the surface of the photosensitive drum 21. When the rotation of the cleaning roller 32 stops, the application of the bias voltage to the cleaning roller 32 also stops.

Figure 12:
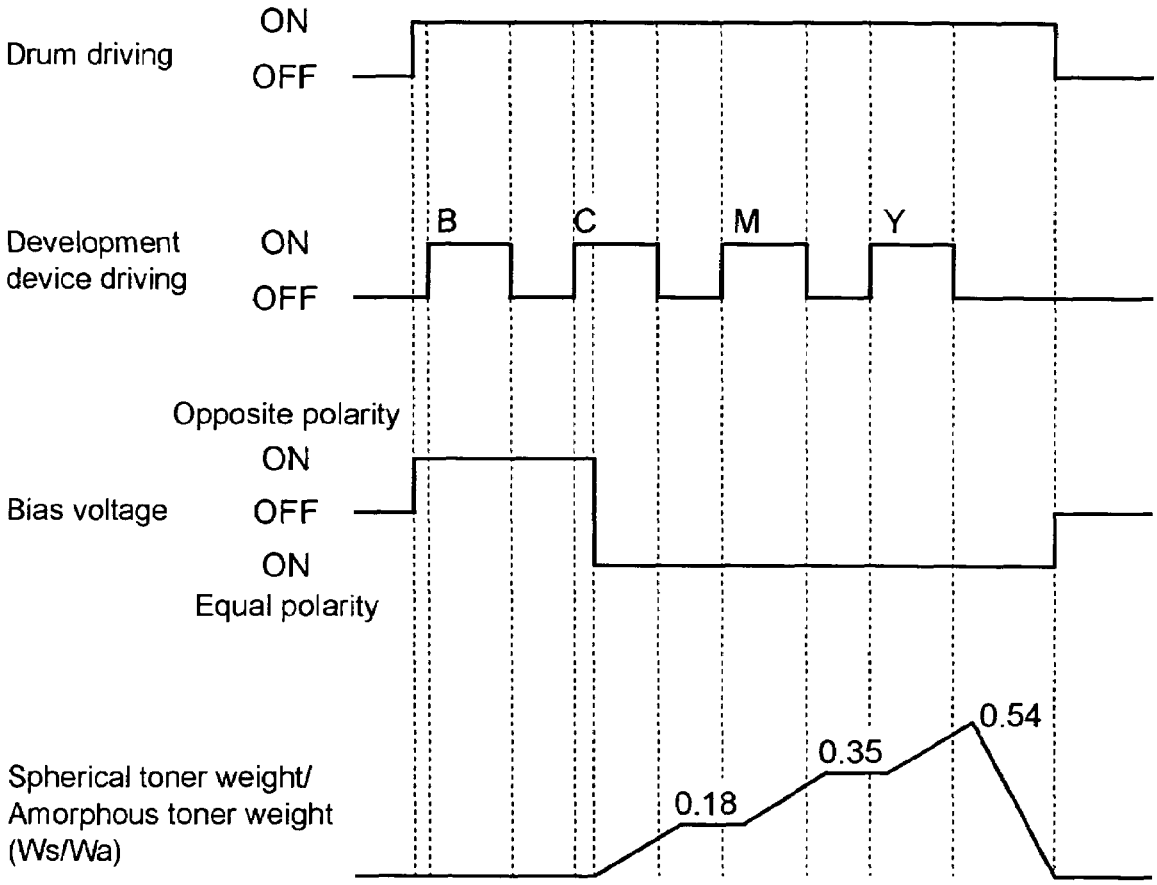
FIG. 12 is a chart of the control performed by a cleaning unit according to a fifth embodiment, with a graph showing a change in the weight ratio of the spherical toner with respect to the amorphous toner.

Next, the fifth embodiment will be described, referring to FIG. 12 in addition to FIGS. 1, 9, and 10. FIG. 12 is a chart of the control performed by the cleaning unit during cleaning, with a graph showing a change in the weight ratio of the spherical toner with respect to the amorphous toner. The construction of the cleaning unit of this embodiment is the same as that of the fourth embodiment; therefore, its indication on the drawings and its description will be omitted. The drawing method employed for FIG. 12 is the same as that for FIG. 11.

As shown in FIG. 12, in the image forming operation performed on the photosensitive drum 21, the photosensitive drum 21 starts to rotate, and subsequently development of the first color, i.e., black, starts. Upon the cleaning of the black toner, i.e., amorphous toner, the power supply portion 40 is controlled by the controller 60 to apply to the cleaning roller 32 a bias voltage opposite in polarity to the charge potential of the toner (see FIG. 9), whereby the black toner remains at the region between the cleaning roller 32 and the cleaning blade 31 near the photosensitive drum 21 until the three color toners, i.e., spherical toners, start to be cleaned.

When the development of the cyan color, the first color of the three colors, is started after the development of the black toner is completed, in order to clean the cyan toner, the power supply portion 40 is controlled by the controller 60 to apply to the cleaning roller 32 a bias voltage equal in polarity to the charge potential of the toner (see FIG. 10). Then, the development and cleaning of the spherical toners, magenta and yellow, continues sequentially. The spherical toners of the different colors are sequentially fed together with the black toner toward the screw 34 under the action of gravity, repelling the cleaning roller 32, and under the guidance of the scraper 33, and then are carried out of the housing 35 by the screw 34. The ratio of the spherical toner weight with respect to the amorphous toner weight increases accordingly as the cyan, magenta, and yellow color toners are developed, reaching a maximum of 0.54, but maintaining below 1.5, immediately before the end of the image forming operation. When the image forming operation is completed, all the four colors have been cleaned, so that the spherical toners are removed together with the amorphous toner from the surface of the photosensitive drum 21.

FIG. 12 refers to an example of control such that a toner remains during the cleaning of the amorphous black toner while a cleaned toner is removed from the aforementioned region during the period from the cleaning of the next spherical cyan toner to the end of the image forming operation. As alternative control, though not shown, a toner may remain during the cleaning of the black toner and the cleaning of the cyan toner while a toner may be removed from the aforementioned region during the period from the cleaning of the magenta toner to the end of image forming operation. Even in such a case, the measurement showed that the ratio of the spherical toner weight to the amorphous toner weight is kept 1.5 or below. Control such that the black, cyan, and magenta toners remain during their cleaning operations while the yellow toner is removed from the aforementioned region during its cleaning operation provides the same results as shown in the example of FIG. 11.

Figure 13:
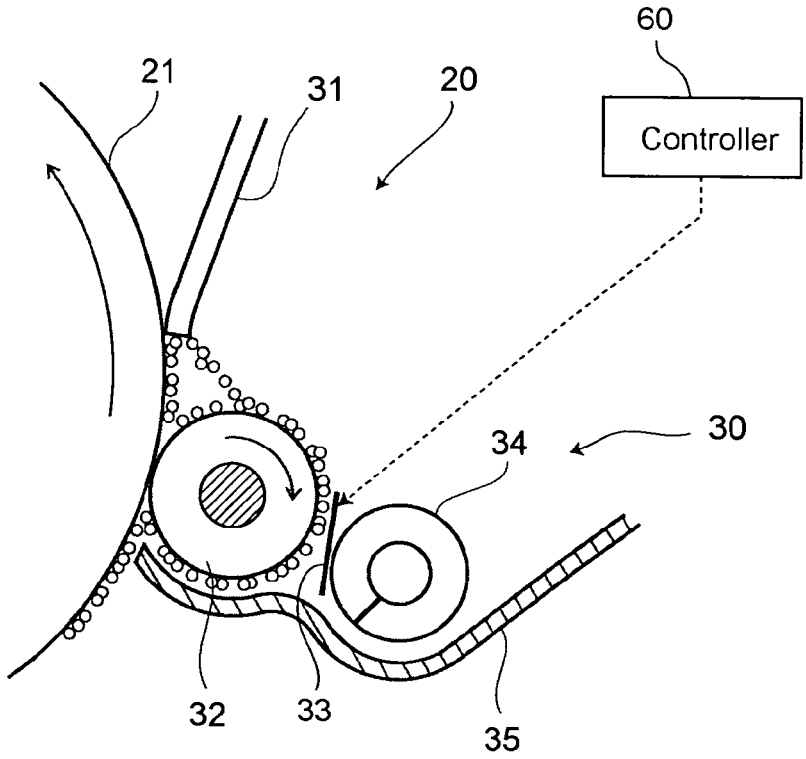
FIG. 13 is a partially enlarged view in a vertical section schematically showing the surrounding of the cleaning unit, with a scraper in a position separated from the cleaning roller.
Figure 14:
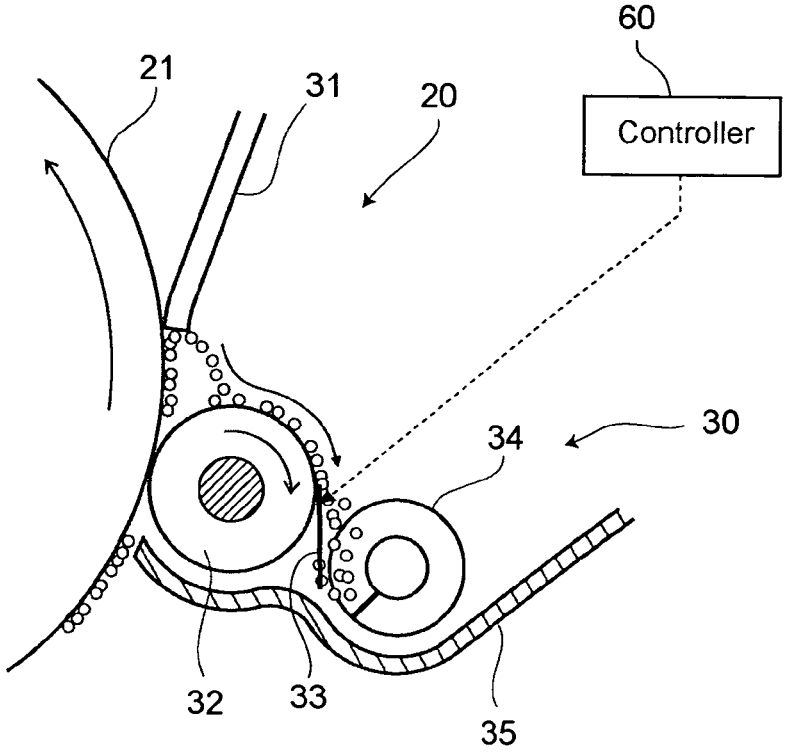
FIG. 14 is a partially enlarged view in a vertical section schematically showing the surrounding of the cleaning unit, with the scraper in a position in contact with the cleaning roller.

Next, referring to FIGS. 13 and 14 in addition to FIG. 1, a description will be given below, concerning a sixth and a seventh embodiments of the present invention, in which toner remaining-removing switching is made by moving the position of the scraper 33 composing the toner remaining-removing switching means 50. FIG. 13 is a partially enlarged view in a vertical section schematically showing the surrounding of the cleaning unit, with the scraper 33 in a position separated from the cleaning roller 32. FIG. 14 is a drawing similar to FIG. 13, but with the scraper 33 in a position in contact with the cleaning roller 32. In these embodiments, the surface of the cleaning roller 32 at the area in contact with the photosensitive drum 21 rotates in the same direction as the moving direction of the surface of the photosensitive drum 21, and thus this rotation direction does not change at later times. No bias voltage is applied to the cleaning roller 32, or an appropriate bias voltage required for cleaning is applied to the cleaning roller 32 though its value is fixed.

As shown in FIG. 13, when the scraper 33 is moved by the controller 60 to the position separated from the cleaning roller 32, the scraper 33 functions as a partition between the cleaning roller 32 and the screw 34, so that a toner cleaned off the surface of the photosensitive drum 21 is not easily fed toward the screw 34 from the surrounding area of the cleaning roller 32. As a result, a toner scraped off the surface of the photosensitive drum 21 by the cleaning blade 31 to thereby drop on the cleaning roller 32 and a toner adhering from the surface of the photosensitive drum 21 directly to the cleaning roller 32 remains adhering to the surface of the cleaning roller 32. Thus, the toner remains at the region between the cleaning blade 31 and the cleaning roller 32 near the photosensitive drum 21.

As shown in FIG. 14, when the scraper 33 is moved by the controller 60 to the position in contact with the cleaning roller 32, the toner adhering to the cleaning roller 32 is scraped off by the scraper 33 and easily guided under the action of gravity toward the screw 34, and then are carried out of the housing 35 by the screw 34.

Figure 15:
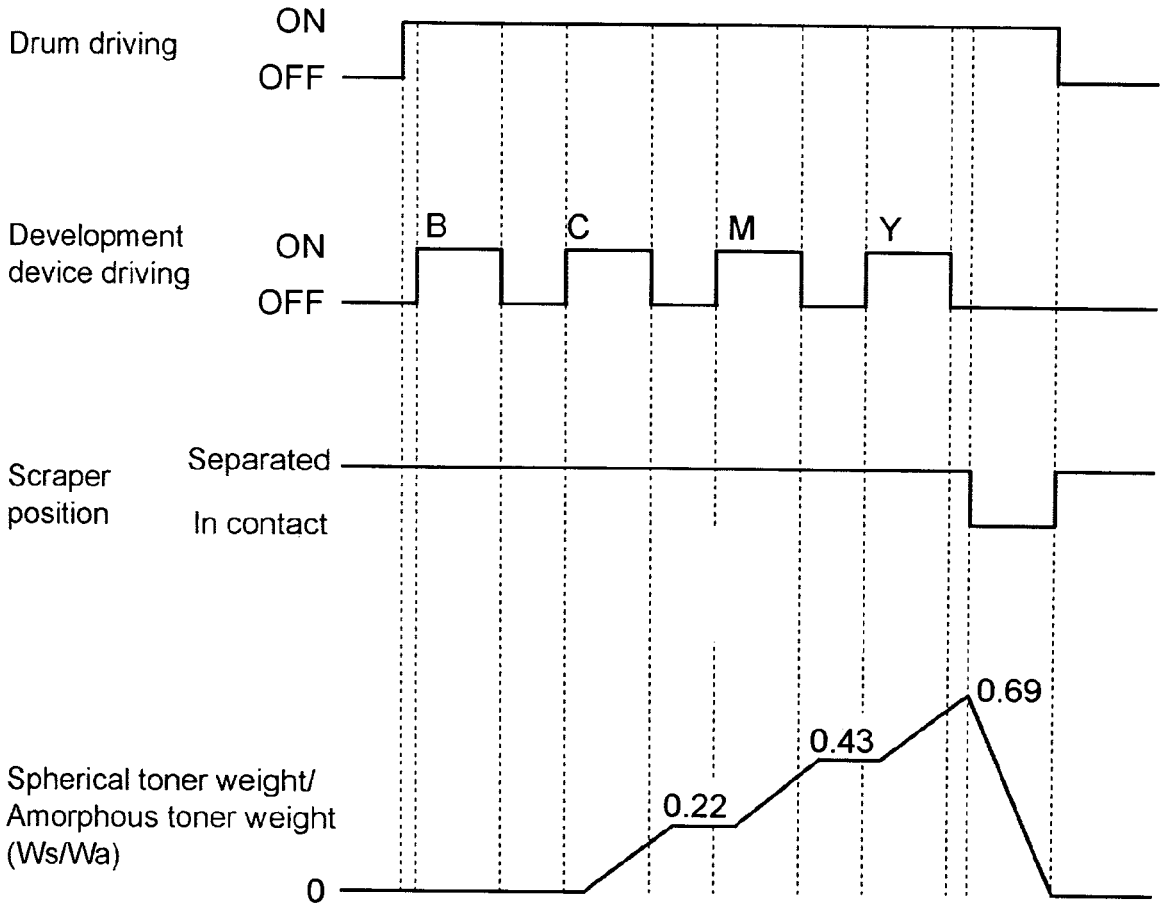
FIG. 15 is a chart of the control performed by a cleaning unit according to a sixth embodiment, with a graph showing a change in the weight ratio of the spherical toner with respect to the amorphous toner.

Next, the sixth embodiment of the present invention will be described, referring to FIG. 15 in addition to FIGS. 1, 13, and 14. FIG. 15 is a chart of the control performed by the cleaning unit during cleaning, with a graph showing a change in the weight ratio of the spherical toner with respect to the amorphous toner. In FIG. 15, the position of the scraper 33 is indicated as "Separated" when it is moved to the position separated from the cleaning roller 32 and indicated as "In contact" when it is moved to the position in contact with the cleaning roller 32. Other indications are the same as those in FIG. 11, and thus are omitted from the description.

As shown in FIG. 15, in the image forming operation performed on the photosensitive drum 21, the photosensitive drum 21 starts to rotate, and subsequently the four development units, the black development unit 23B, the cyan development unit 23C, the magenta development unit 23M, and the yellow development unit 23Y, are sequentially driven, and then a color toner image is formed on the surface of the intermediate transfer belt 24 (see FIG. 1).

During the image forming operation, the scraper 33 is controlled by the controller 60 to be moved to the position separated from the cleaning roller 32 (see FIG. 13). As a result, all the four color toners remain at the region between the cleaning blade 31 and the cleaning roller 32 near the photosensitive drum 21 until the end of the development of all the colors. The ratio of the spherical toner weight with respect to the amorphous toner weight increases accordingly as the cyan, magenta, and yellow color toners are developed sequentially, reaching a maximum of 0.69, but maintaining below 1.5, immediately before the end of the image forming operation.

When the development of all the four colors is completed, the scraper 33 is controlled by the controller 60 to be moved to the position in contact with the cleaning roller 32 (see FIG. 14). The toners of all the four colors are scraped off by the scraper 33 and easily guided under the action of gravity toward the screw 34, and then are carried out of the housing 35 by the screw 34. When the rotation of the cleaning roller 32 stops, the scraper 33 is forced to be moved again to the position separated from the cleaning roller 32.

Figure 16:
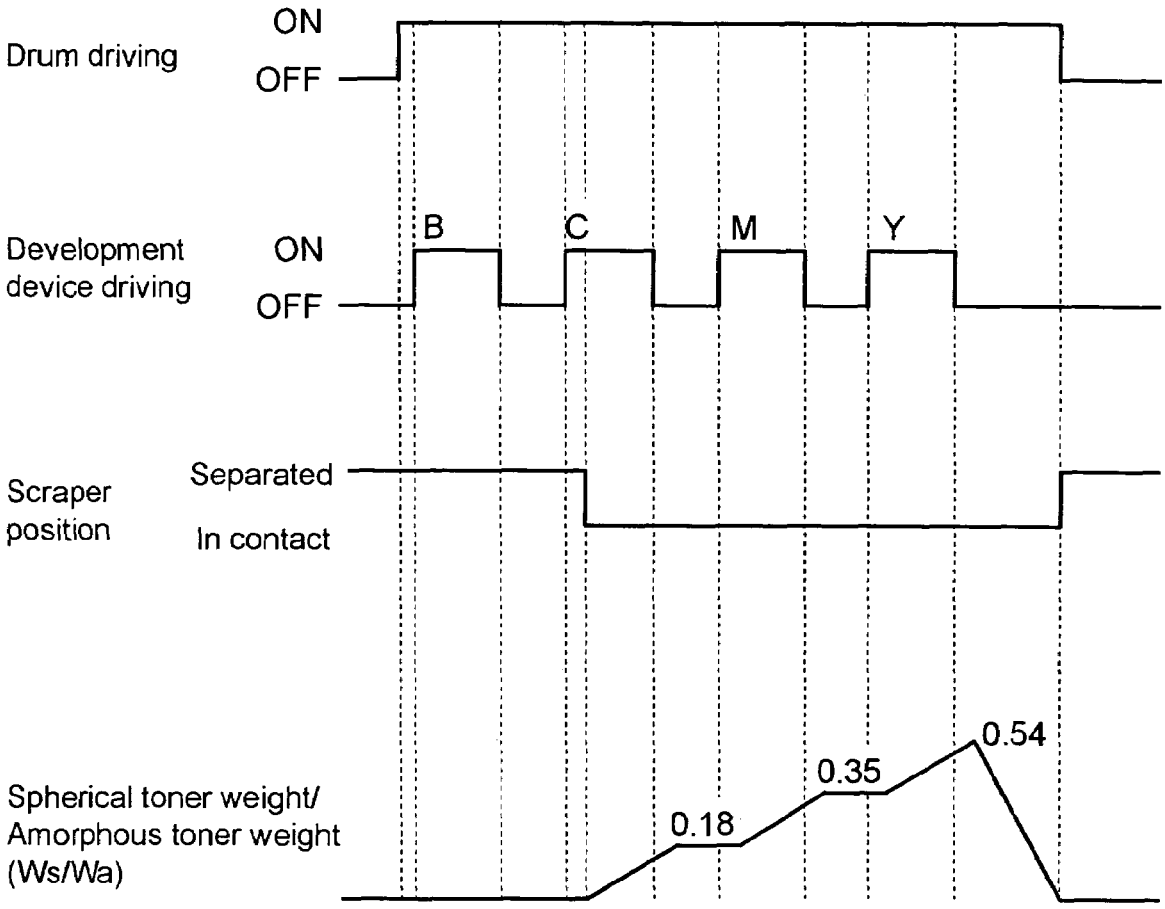
FIG. 16 is a chart of the control performed by a cleaning unit according to a seventh embodiment, with a graph showing a change in the weight ratio of the spherical toner with respect to the amorphous toner.

Next, modification of the cleaning operation performed by the cleaning unit 30 in the sixth embodiment will be described as a seventh embodiment of the invention, referring to FIG. 16 in addition to FIGS. 1, 13, and 14. FIG. 16 is a chart of the control performed by the cleaning unit during cleaning, with a graph showing a change in the weight ratio of the spherical toner with respect to the amorphous toner. The construction of the cleaning unit of this embodiment is the same as that of the sixth embodiment; therefore, its indication on the drawings and its description will be omitted. The drawing method employed for FIG. 16 is the same as that for FIG. 15.

As shown in FIG. 16, in the image forming operation performed on the photosensitive drum 21, the photosensitive drum 21 starts to rotate, and subsequently development of the first color, i.e., black, starts. Upon the cleaning of the black toner, i.e., amorphous toner, the scraper 33 is moved by the controller 60 to the position separated from the cleaning roller 32 (see FIG. 13), whereby the amorphous toner remains at the region between the cleaning roller 32 and the cleaning blade 31 near the photosensitive drum 21 until the three color toners, i.e., spherical toners, start to be cleaned.

When the development of the cyan color, the first color of the three colors, is started after the development of the black toner is completed, in order to clean the cyan toner, the scraper 33 is moved by the controller 60 to the position in contact with the cleaning roller 32 (see FIG. 14). Then, the development and cleaning of the spherical toner, magenta and yellow, continues sequentially. The spherical toners of the different colors are sequentially guided together with the amorphous black toner across the scraper 33 toward the screw 34, and then are carried out of the housing 35 by the screw 34. The ratio of the spherical toner weight with respect to the amorphous toner weight increases accordingly as the cyan, magenta, and yellow color toners are developed subsequently, reaching a maximum of 0.54, but maintaining below 1.5, immediately before the end of the image forming operation.

FIG. 16 refers to an example of control such that a toner remains during the cleaning of the amorphous black toner while a cleaned toner is removed from the aforementioned region during the period from the cleaning of the next spherical cyan toner to the end of the image forming operation. As alternative control, though not shown, a toner may remain during the cleaning of the black toner and the cleaning of the cyan toner while a toner may be removed from the aforementioned region during the period from the cleaning of the magenta toner to the end of image forming operation, i.e., during the cleaning of the remaining spherical toners. Even in such a case, the measurement showed that the ratio of the spherical toner weight with respect to the amorphous toner weight is kept 1.5 or below. Control such that the black, cyan, and magenta toners remain during their cleaning operations while the yellow toner is removed from the aforementioned region during its cleaning operation provides the same results as shown in the example of FIG. 15.

Upon the completion of the image forming operation, the cleaning of all the four color toners is also completed, so that the spherical toners are removed together with the amorphous toner from the surface of the photosensitive drum 21. When the rotation of the cleaning roller 32 stops, the scraper 33 is again forced to be moved to the position separated from the cleaning roller 32.

The descriptions have been given above on the embodiments in which the toner remaining-removing switching means 50 (FIG. 2) is provided by employing and controlling any one of the rotation direction of the cleaning roller 32, the position of the scraper 33, and the bias voltage applied to the cleaning roller 32 to achieve toner remaining-removing switching. However, two or all of these may be combined to achieve the aforementioned switching, thereby permitting even more reliable control of toner remaining and removal.

Referring to FIGS. 17 to 24, brief descriptions will be given on the control made by combining two or all of the rotation direction of the cleaning roller 32, the position of the scraper 33, and the bias voltage applied to the cleaning roller 32.

Figure 17:
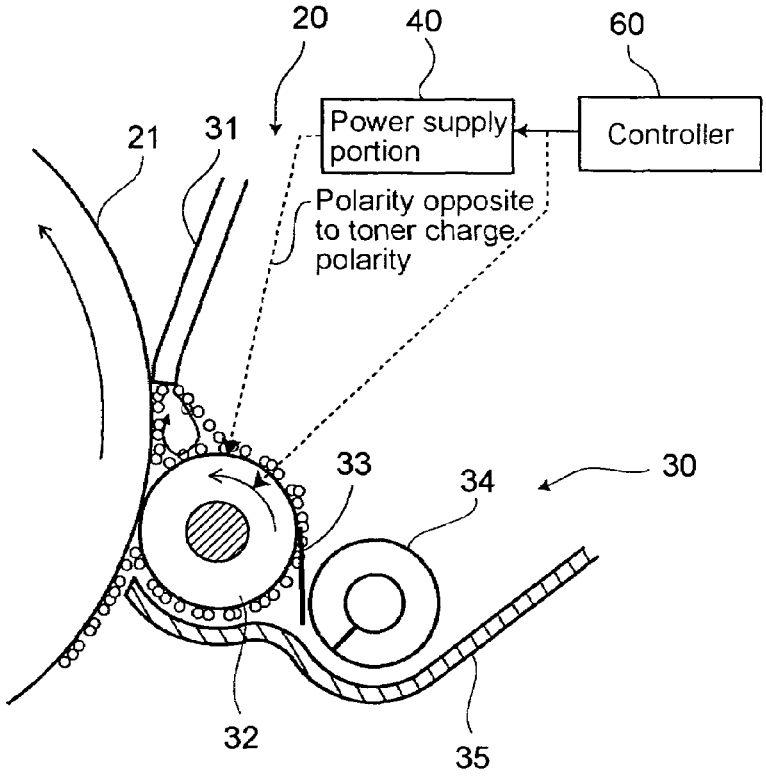
FIG. 17 is a partially enlarged view in a vertical section schematically showing the surrounding of a cleaning unit according to an eight to a tenth embodiments, with controls of the cleaning roller and a bias voltage.
Figure 18:
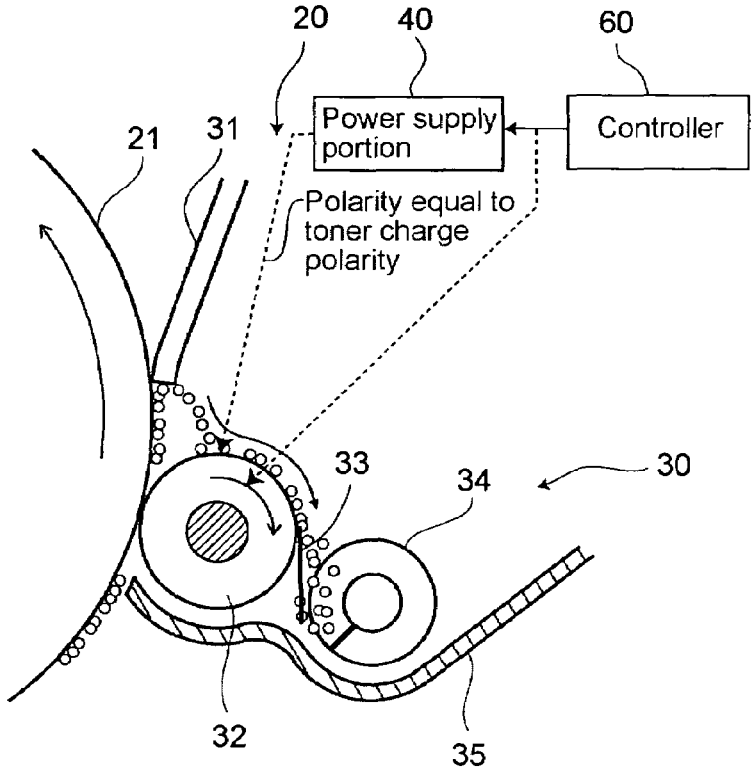
FIG. 18 is a partially enlarged view in a vertical section schematically showing the surrounding of a cleaning unit according to an eight to a tenth embodiments, with controls of a cleaning roller and a bias voltage.

FIGS. 17 and 18 show combined control of switching the rotation of the cleaning roller 32 and switching the polarity of the bias voltage upon its application. As shown in FIG. 17, in order to make a toner remain, the controller 60 rotates the surface of the cleaning roller 32 at the area in contact with the photosensitive drum 21 in the direction opposite to the moving direction of the surface of the photosensitive drum 21, and, at the same time, applies to the cleaning roller 32 a bias voltage opposite in polarity to the charge potential of the toner. As shown in FIG. 18, in order to make a toner removed, the controller 60 rotates the surface of the cleaning roller 32 at the area in contact with the photosensitive drum 21 in the same direction as the moving direction of the surface of the photosensitive drum 21, and, at the same time, applies to the cleaning roller 32 a bias voltage equal in polarity to the charge potential of the toner. In either case, the scraper 33 is fixed in contact with the cleaning roller 32.

Based on the configuration described above, an eighth to a tenth embodiments will be described below briefly. In the eighth embodiment, the rotation direction of the cleaning roller 32 is switched in the same way with the same timing as shown in FIG. 6 and as described referring to FIG. 6. In the eighth embodiment, the polarity of the bias voltage is switched in the same way as shown in FIG. 11 and as described referring to FIG. 11. In the ninth embodiment, the rotation direction of the cleaning roller 32 is switched in the same way with the same timing as shown in FIG. 7 and as described referring to FIG. 7. In the ninth embodiment, the polarity of the bias voltage is switched in the same way as shown in FIG. 12 and as described referring to FIG. 12. In the tenth embodiment, the rotation direction of the cleaning roller 32 is switched in the same way with the same timing as shown in FIG. 8 and as described referring to FIG. 8. In the tenth embodiment, the polarity of the bias voltage is switched in the same way as shown in FIG. 12 and as described referring to FIG. 12.

Figure 19:
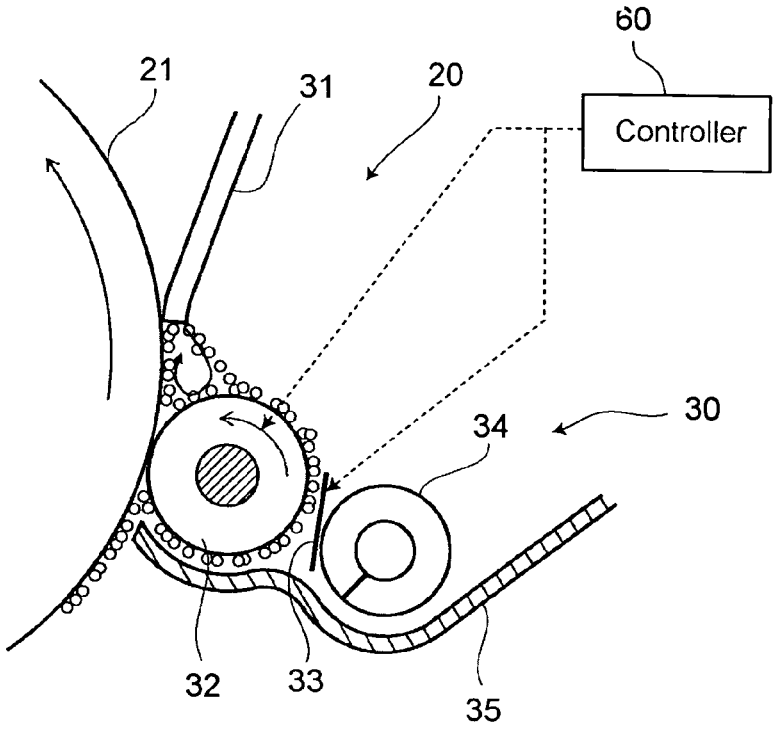
FIG. 19 is a partially enlarged view in a vertical section schematically showing the surrounding of a cleaning unit according to an eleventh to a thirteenth embodiments, with controls of a cleaning roller and a scraper.
Figure 20:
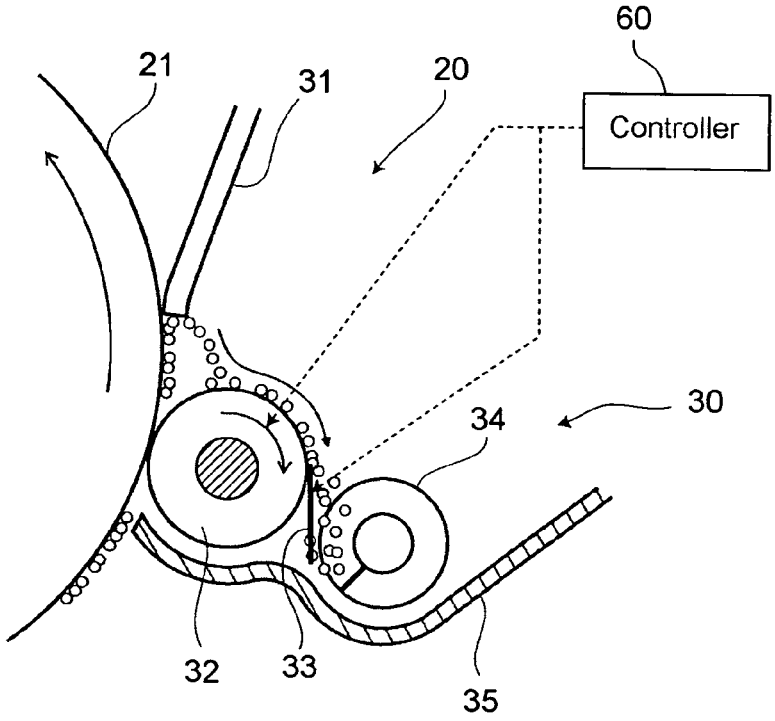
FIG. 20 is a partially enlarged view in a vertical section schematically showing the surrounding of a cleaning unit according to an eleventh to a thirteenth embodiments, with controls of a cleaning roller and a scraper.

FIGS. 19 and 20 show combined control of switching the rotation direction of the cleaning roller 32 and the position of the scraper 33. As shown in FIG. 19, in order to make a toner remain, the controller 60 rotates the surface of the cleaning roller 32 at the area in contact with the photosensitive drum 21 in the direction opposite to the moving direction of the surface of the photosensitive drum 21, and, at the same time, moves the scraper 33 to the position separated from the cleaning roller 32. As shown in FIG. 20, in order to make a toner removed, the controller 60 rotates the surface of the cleaning roller 32 at the area in contact with the photosensitive drum 21 in the same direction as the moving direction of the surface of the photosensitive drum 21, and, at the same time, moves the scraper 33 to the position in contact with the cleaning roller 32. In either case, no bias voltage is applied to the cleaning roller 32, or an appropriate bias voltage required for cleaning is applied thereto, but its value is fixed.

Based on the configuration described above, an eleventh to a thirteenth embodiments will be described below briefly. In the eleventh embodiment, the rotation direction of the cleaning roller 32 is switched in the same way with the same timing as shown in FIG. 6 and as described referring to FIG. 6. In the eleventh embodiment, the position of the scraper 33 is switched in the same way as shown in FIG. 15 and as described referring to FIG. 15. In the twelfth embodiment, the rotation direction of the cleaning roller 32 is switched in the same way with the same timing as shown in FIG. 7 and as described referring to FIG. 7. In the twelfth embodiment, the position of the scraper 33 is switched in the same way as shown in FIG. 16 and as described referring to FIG. 16. In the thirteenth embodiment, the rotation direction of the cleaning roller 32 is switched in the same way with the same timing as shown in FIG. 8 and as described referring to FIG. 8. In the thirteenth embodiment, the position of the scraper 33 is switched in the same way as shown in FIG. 16 and as described referring to FIG. 16.

Figure 21:
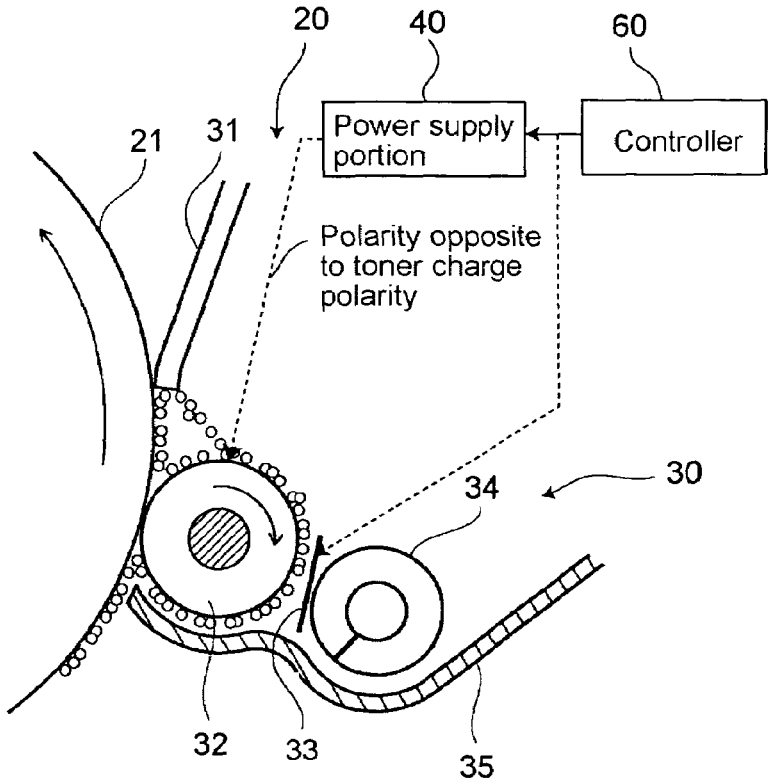
FIG. 21 is a partially enlarged view in a vertical section schematically showing the surrounding of a cleaning unit according to a fourteenth to a fifteenth embodiments, with controls of a bias voltage and a scraper.
Figure 22:
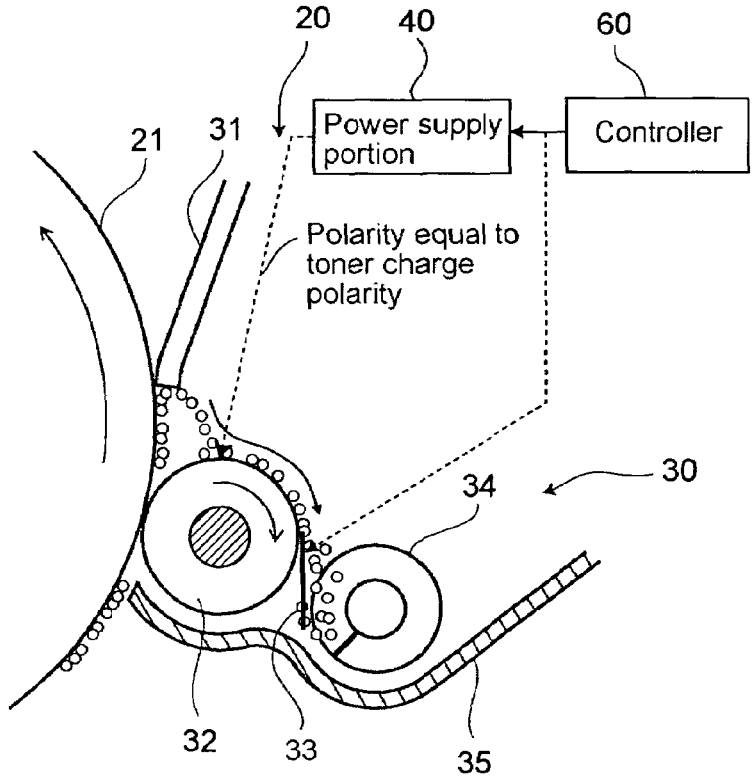
FIG. 22 is a partially enlarged view in a vertical section schematically showing the surrounding of a cleaning unit according to an eleventh to a thirteenth embodiments, with controls of a bias voltage and a scraper.

FIGS. 21 and 22 show combined control of switching the polarity of the bias voltage upon its application and switching the position of the scraper 33. As shown in FIG. 21, in order to make a toner remain, the controller 60 applies to the cleaning roller 32 a bias voltage opposite in polarity to the charge potential of the toner, and, at the same time, moves the scraper 33 to the position separated from the cleaning roller 32. As shown in FIG. 22, in order to make a toner removed, the controller 60 applies to the cleaning roller 32 a bias voltage equal in polarity to the charge potential of the toner, and, at the same time, moves the scraper 33 to the position in contact with the cleaning roller 32. In either case, the surface of the cleaning roller 32 at the area in contact with the photosensitive drum 21 rotates in the same direction as the moving direction of the surface of the photosensitive drum 21, and thus the rotation direction is not switched.

Based on the configuration described above, a fourteenth to a fifteenth embodiments will be described below briefly. In the fourteenth embodiment, the polarity of the bias voltage is switched in the same way with the same timing as shown in FIG. 11 and as described referring to FIG. 11. In the fourteenth embodiment, the position of the scraper 33 is switched in the same way as shown in FIG. 15 and as described referring to FIG. 15. In the fifteenth embodiment, the polarity of the bias voltage is switched in the same way with the same timing as shown in FIG. 12 and as described referring to FIG. 12. In the fifteenth embodiment, the position of the scraper 33 is switched in the same way as shown in FIG. 16 and as described referring to FIG. 16.

Figure 23:
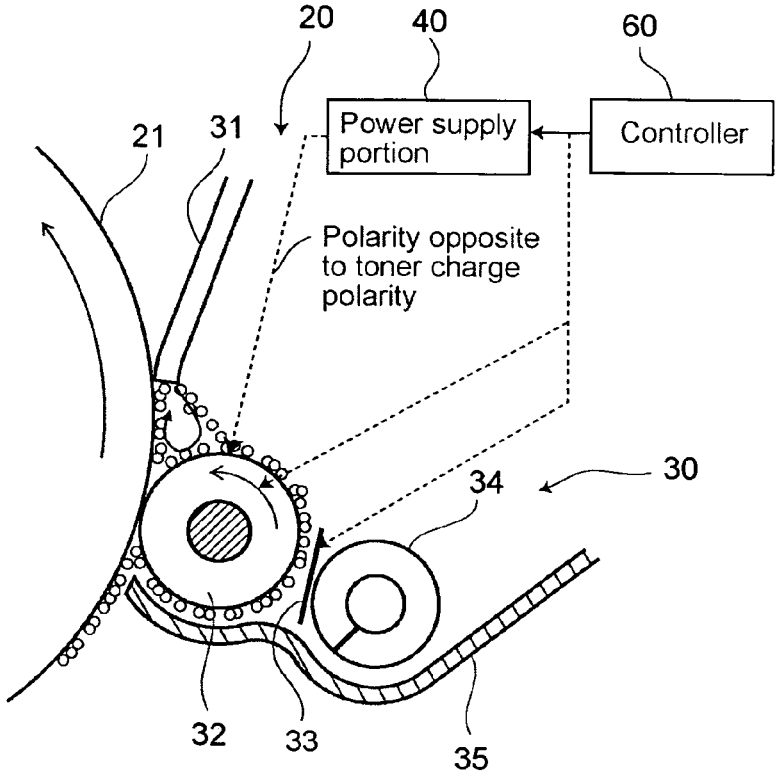
FIG. 23 is a partially enlarged view in a vertical section schematically showing the surrounding of a cleaning unit according to a sixteenth to an eighteenth embodiments, with controls of a bias voltage and a scraper.
Figure 24:
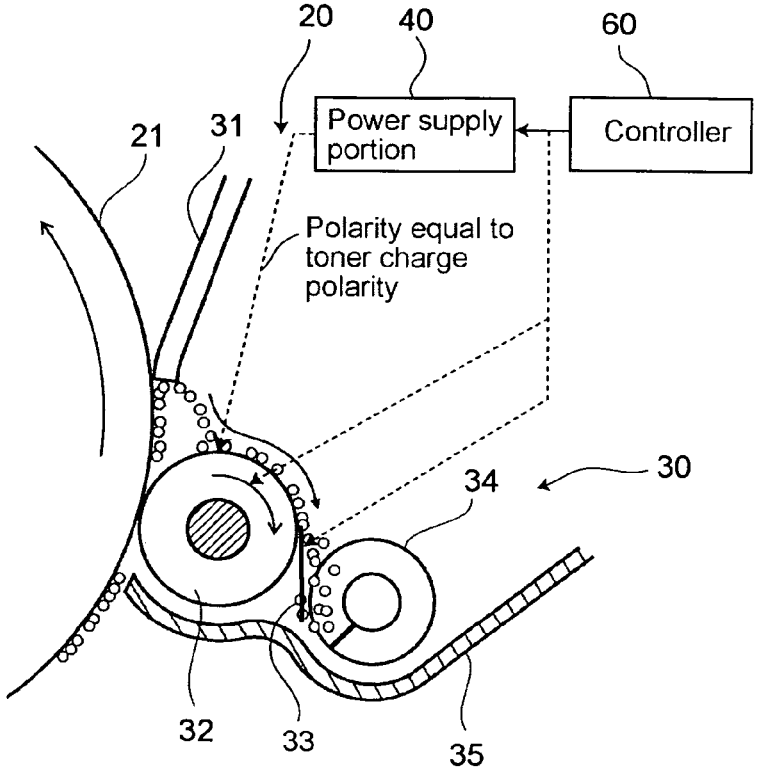
FIG. 24 is a partially enlarged view in a vertical section schematically showing the surrounding of a cleaning unit according to a sixteenth to an eighteenth embodiments, with controls of a bias voltage and a scraper.

FIGS. 23 and 24 show combined control of switching the rotation direction of the cleaning roller 32, switching the polarity of the bias voltage upon its application, and switching the position of the scraper 33. As shown in FIG. 23, in order to make a toner remain, the controller 60 rotates the surface of the cleaning roller 32 at the area in contact with the photosensitive drum 21 in the direction opposite to the moving direction of the surface of the photosensitive drum 21, and, at the same time, applies to the cleaning roller 32 a bias voltage opposite in polarity to the charge potential of the toner, and further, moves the scraper 33 to the position separated from the cleaning roller 32. As shown in FIG. 24, in order to make a toner removed, the controller 60 rotates the surface of the cleaning roller 32 at the area in contact with the photosensitive drum 21 in the same direction as the moving direction of the surface of the photosensitive drum 21, and, at the same time, applies to the cleaning roller 32 a bias voltage equal in polarity to the charge potential of the toner, and further, moves the scraper 33 to the position in contact with the cleaning roller 32.

Based on the configuration described above, a sixteenth to a eighteenth embodiments will be described below briefly. In the sixteenth embodiment, the rotation direction of the cleaning roller 32 is switched in the same way with the same timing as shown in FIG. 6 and as described referring to FIG. 6. In the sixteenth embodiment, the bias voltage is switched in the same way as shown in FIG. 11 and as described referring to FIG. 11. Further, in the sixteenth embodiment, the position of the scraper 33 is switched in the same way as shown in FIG. 15 and as described referring to FIG. 15. In the seventeenth embodiment, the rotation direction of the cleaning roller 32 is switched in the same way with the same timing as shown in FIG. 7 and as described referring to FIG. 7. In the seventeenth embodiment, the polarity of the bias voltage is switched in the same way as shown in FIG. 12 and as described referring to FIG. 12. Further, in the seventeenth embodiment, the position of the scraper 33 is switched in the same way as shown in FIG. 16 and as described referring to FIG. 16. In the eighteenth embodiment, the rotation direction of the cleaning roller 32 is switched in the same way with the same timing as shown in FIG. 8 and as described referring to FIG. 8. In the eighteenth embodiment, the polarity of the bias voltage is switched in the same way as shown in FIG. 12 and as described referring to FIG. 12. Further, in the eighteenth embodiment, the position of the scraper 33 is switched in the same way as shown in FIG. 16 and as described referring to FIG. 16.

As described above, according to the present invention, although an amorphous toner is used for one color, spherical toners, which can be produced at low cost and which provide high quality, are used for other colors, thus achieving a high-quality image while easily overcoming cleaning failures involved with the use of spherical toners. Moreover, in any of the embodiments described above, since already available components and structures which are usually provided to a cleaning unit are used, no additional devices and no additional space for their attachment are required, thus achieving cost reduction and space saving of the cleaning unit.

In an image forming apparatus provided with the cleaning unit of the present invention, a favorable performance can be maintained in cleaning a residual toner on the surface of the photosensitive drum 21 without any impairment to a clear, high-quality image obtained through the use of spherical toners. Moreover, unlike the example of conventional art described above, any toner unnecessary for actual image formation is not used, thus providing a low-cost, high-performance image forming apparatus taking resources and environment into consideration.

The present invention has been described, referring to the embodiments above. However, the scope of the invention is not limited to them; therefore, various modifications can be made without departing from the spirits of the invention.

What is claimed is:

1. A cleaning unit for, in order to achieve image formation by use of amorphous and spherical toners of a plurality of different colors, sequentially cleaning a toner remaining on a surface of an image carrier, which repeats a process comprising development, transfer, and cleaning for each of the colors, by a blade making contact with the image carrier and then scraping off the toner adhering to the surface thereof for each process, the cleaning unit comprising:

toner remaining-removing switching means comprising a rotary member which makes contact with the image carrier, the switching means being provided upstream of the blade in a rotation direction of the image carrier and permitting switching such that the toner scraped off by the blade remains at a predetermined region between the blade and the rotary member near the image carrier or the toner is removed from the predetermined region; and a controller for controlling switching made by the toner remaining-removing switching means, wherein the process by use of the amorphous toner is first performed in the image formation, and wherein the controller switches the toner remaining-removing switching means to make the toner scraped off including the amorphous toner remain at the predetermined region during the cleaning in the first process and maintains the toner including the amorphous toner remaining at the predetermined region, and thereafter switches the toner remaining-removing switching means to make the toner scraped off removed from the predetermined region during the cleaning starting from any of the subsequent processes until an end of the image formation.

2. The cleaning unit according to claim 1, wherein a rotation direction of the rotary member is controlled by the controller such that, in order to make a toner remain at the predetermined region, a surface of the rotary member at an area in contact with the image carrier rotates in a direction opposite to a moving direction of the surface of the image carrier, and such that, in order to make a toner removed from the predetermined region, the surface of the rotary member at the area in contact with the image carrier rotates in a same direction as the moving direction of the surface of the image carrier.

3. The cleaning unit according to claim 2, wherein the controller rotates the rotary member in the opposite direction during the cleaning in the first process and thereafter maintains the rotation in the opposite direction, and then rotates the rotary member in the same direction during the cleaning in the last process in the image formation.

4. The cleaning unit according to claim 2, wherein the controller rotates the rotary member in the opposite direction during the cleaning of the amorphous toner, and then rotates the rotary member in the same direction during the cleaning of the first spherical toner and maintains the rotation in the same direction until the last process in the image formation.

5. The cleaning unit according to claim 4, wherein, in order to rotate the rotary member in the same direction, the controller causes the rotary member to follow a rotation of the image carrier.

6. The cleaning unit according to claim 2, wherein the controller rotates the rotary member in the opposite direction during the cleaning of the amorphous toner and maintains the rotation in the opposite direction, and then rotates the rotary member in the same direction during the cleaning of any of the spherical toners and maintains the rotation in the same direction until the last process in the image formation.

7. The cleaning unit according to claim 2, wherein the toner remaining-removing switching means further comprises a power supply portion which is controlled by the controller to apply to the rotary member a bias voltage with a polarity opposite to a charge polarity of a toner so as to help the toner remain on the region when the rotary member rotates in the opposite direction and which is controlled by the controller to apply to the rotary member a bias voltage with a polarity equal to a charge polarity of a toner so as to help the toner removed from the region when the rotary member rotates in the same direction.

8. The cleaning unit according to claim 7, wherein the toner remaining-removing switching means further comprises a scraper which is controlled by the controller to be separated from the surface of the rotary member so as to help a toner remain on the region when the rotary member rotates in the opposite direction and which is controlled by the controller to be in contact with the surface of the rotary member so as to help a toner removed from the region when the rotary member rotates in the same direction.

9. The cleaning unit according to claim 2, wherein the toner remaining-removing switching means further comprises a scraper which is controlled by the controller to be separated from the surface of the rotary member so as to help a toner remain on the region when the rotary member rotates in the opposite direction and which is controlled by the controller to be in contact with the surface of the rotary member so as to help a toner removed from the region when the rotary member rotates in the same direction.

10. The cleaning unit according to claim 1, wherein the toner remaining-removing switching means comprises: a rotary member which makes contact with the image carrier and whose surface at an area in contact with the image carrier rotates in a same direction as a moving direction of the surface of the image carrier, and a power supply portion which is controlled by the controller to apply to the rotary member a bias voltage with a polarity opposite to a charge polarity of a toner in order to make the toner remain on the region and which is controlled by the controller to apply to the rotary member a bias voltage with a polarity equal to a charge polarity of a toner in order to make the toner removed from the region.

11. The cleaning unit according to claim 10, wherein, through the power supply portion, the controller applies to the rotary member the bias voltage with the opposite polarity during the cleaning in the first process and thereafter maintains the bias voltage with the opposite polarity, and then applies to the rotary member the bias voltage with the equal polarity during the cleaning in the last process in the image formation.

12. The cleaning unit according to claim 10, wherein, through the power supply portion, the controller applies to the rotary member the bias voltage with the opposite polarity during the cleaning of the amorphous toner, and then applies to the rotary member the bias voltage with the equal polarity during the cleaning of the first spherical toner and maintains the bias voltage with the equal polarity until the last process in the image formation.

13. The cleaning unit according to claim 10, wherein, through the power supply portion, the controller applies to the rotary member the bias voltage with the opposite polarity during the cleaning of the amorphous toner, and then applies to the rotary member the bias voltage with the equal polarity during the cleaning of any of the spherical toners and maintains the bias voltage with the equal polarity until the last process in the image formation.

14. The cleaning unit according to claim 10, wherein the toner remaining-removing switching means further comprises a scraper which is controlled by the controller to be separated from the surface of the rotary member so as to help a toner remain on the region when a bias voltage with a polarity opposite to a charge polarity of the toner is applied to the rotary member and which is controlled by the controller to be in contact with the surface of the rotary member so as to help a toner removed from the region when a bias voltage with a polarity equal to a charge polarity of the toner is applied to the rotary member.

15. The cleaning unit according to claim 1, wherein the toner remaining-removing switching means comprises: a rotary member which makes contact with the image carrier and whose surface at an area in contact with the image carrier rotates in a same direction as a moving direction of the surface of the image carrier, and a scraper which is controlled by the controller to be at a position separated from the surface of the rotary member in order to make a toner remain on the region and which is controlled by the controller to be at a position in contact with the surface of the rotary member in order to make a toner removed from the region.

16. The cleaning unit according to claim 15, wherein the controller controls the scraper to be at the separated position during the cleaning in the first process, and thereafter continues the separated position, and then controls the scraper to be at the position in contact during the cleaning in the last process in the image formation.

17. The cleaning unit according to claim 15, wherein the controller controls the scraper to be at the separated position during the cleaning of the amorphous toner, then controls the scraper to be at the position in contact during the cleaning of the first spherical toner, and then maintains the position in contact until the last process in the image formation.

18. The cleaning unit according to claim 15, wherein the controller controls the scraper to be at the separated position during the cleaning of the amorphous toner, then controls the scraper to be at the position in contact during the cleaning of any of the spherical toners, and then maintains the position in contact until the last process in the image formation.

19. The cleaning unit according to claim 1, wherein the amorphous toner is a black toner and the spherical toners are toners of colors other than black.

20. The cleaning unit according to claim 1, wherein the controller controls switching made by the toner remaining-removing switching means so as to provide a relationship such that a ratio of a weight of the spherical toner present in the toner scraped off with respect to a weight of the amorphous toner present in the toner scraped off is constantly 1.5 or below during the cleaning in the process.

21. An image forming apparatus comprising the cleaning unit according to claim 1.

22. A cleaning method for, in order to achieve image formation by use of amorphous and spherical toners of a plurality of different colors, sequentially cleaning toner remaining on a surface of an image carrier, which repeats a process comprising development, transfer, and cleaning for each of the colors, by a blade making contact with the image carrier and then scraping off the toner adhering to the surface thereof for each process, the cleaning method comprising the steps of:

scraping off by the blade toner used in a process of a first color and remaining on the image carrier;

keeping the toner scraped off remaining at a predetermined region near where the blade and the image carrier make contact with each other until the cleaning starts in any of the subsequent processes for remaining colors including a second color until an end of the image formation; and starting removing the toner remaining at the predetermined region and toner newly scraped off by cleaning from a time when the cleaning starts in said any of the subsequent processes for remaining colors including the second color, wherein the amorphous toner is used in the process of the first color, and the spherical toner is used in said subsequent processes for remaining colors including the second color.

* * * * *